US011161081B2

(12) United States Patent
Griffiths et al.

(10) Patent No.: US 11,161,081 B2
(45) Date of Patent: Nov. 2, 2021

(54) NANOBUBBLE GENERATOR

(71) Applicant: NANO BUBBLE TECHNOLOGIES PTY LTD, Sydney (AU)

(72) Inventors: Andrew Peter Griffiths, Narre Warren South (AU); Kevin Vincent Finn, Berwick (AU)

(73) Assignee: NANO BUBBLE TECHNOLOGIES PTY LTD, Sydney (AU)

( * ) Notice: Subject to any disclaimer, the term of this patent is extended or adjusted under 35 U.S.C. 154(b) by 248 days.

(21) Appl. No.: 16/347,558

(22) PCT Filed: Nov. 3, 2017

(86) PCT No.: PCT/AU2017/051213
§ 371 (c)(1),
(2) Date: May 3, 2019

(87) PCT Pub. No.: WO2018/081868
PCT Pub. Date: May 11, 2018

(65) Prior Publication Data

US 2019/0344224 A1 Nov. 14, 2019

(30) Foreign Application Priority Data

Nov. 3, 2016 (AU) ..... 2016904494

(51) Int. Cl.
*B01F 3/04* (2006.01)
*B01F 5/04* (2006.01)

(52) U.S. Cl.
CPC ..... *B01F 3/04262* (2013.01); *B01F 5/0476* (2013.01)

(58) Field of Classification Search
CPC .. B01F 3/04262; B01F 5/0476; B01F 5/0478; B01F 5/048; B01F 5/0481; B01F 5/0483;
(Continued)

(56) References Cited

U.S. PATENT DOCUMENTS 2,758,714 A * 8/1956 Hollingsworth ..... B03D 1/1412 209/168
3,545,731 A 12/1970 Mcmanus
(Continued)

FOREIGN PATENT DOCUMENTS

KR 1020120002681 A 1/2012

OTHER PUBLICATIONS

Mott Corporation, "Mott Sampling Filter Series 8501 Sparger or Gas/Liquid Contactor," Mott Corporation Brochure, retrieved Sep. 19, 2016.

(Continued)

*Primary Examiner* — Stephen Hobson
(74) *Attorney, Agent, or Firm* — Rimôn, P.C.

(57) ABSTRACT

The present disclosure relates to an apparatus for generating nanobubbles of a gas in a liquid, the apparatus including: (a) an outer tube; (b) a porous inner tube coaxially located within the outer tube that is at least partially occluded so as to define one or more liquid flow paths through the inner tube; (c) a pair of end assemblies attached to respective first and second ends of the outer tube, each end assembly having an opening in fluid communication with the one or more liquid flow paths so as to allow a flow of liquid in an axial direction through the apparatus; and, (d) a gas inlet for allowing a flow of gas into a chamber formed between the outer and inner tube, the flow of gas permitted to permeate through the porous inner tube into the one or more liquid flow paths, wherein, as the gas permeates through the porous inner tube, nanobubbles of gas are generated which become entrained in the liquid flow.

20 Claims, 21 Drawing Sheets

(58) Field of Classification Search
CPC .. B01F 5/0471; B01F 5/0485; B01F 3/04106; B01F 3/04
See application file for complete search history.

(56) References Cited

U.S. PATENT DOCUMENTS

| | | | | | |
|---|---|---|---|---|---|
| 4,897,204 | A * | 1/1990 | Katoh | B01F 3/0446 | 210/220 |
| 4,992,216 | A * | 2/1991 | Saita | B01F 3/0446 | 261/122.1 |
| 5,078,921 | A * | 1/1992 | Zipperian | B01F 3/04475 | 209/170 |
| 5,451,104 | A * | 9/1995 | Kleen | B01F 3/04446 | 366/101 |
| 5,670,094 | A * | 9/1997 | Sasaki | C02F 1/78 | 261/27 |
| 5,814,210 | A * | 9/1998 | Yoon | B03D 1/082 | 209/164 |
| 5,845,993 | A * | 12/1998 | Shirtum | B01F 5/0682 | 366/348 |
| 5,885,466 | A * | 3/1999 | Kelly | C02F 7/00 | 210/750 |
| 5,917,066 | A * | 6/1999 | Eisenmann | B01D 46/0012 | 55/502 |
| 6,103,123 | A * | 8/2000 | Gantzer | B01F 3/0876 | 210/605 |
| 6,237,897 | B1 * | 5/2001 | Marina | B01F 5/0413 | 137/855 |
| 6,328,854 | B1 | 12/2001 | Sherman et al. | | |
| 7,591,452 | B2 * | 9/2009 | Kohama | B01F 3/04262 | 261/102 |
| 7,708,013 | B2 * | 5/2010 | Niland | B01F 5/0476 | 128/201.13 |
| 8,678,354 | B2 * | 3/2014 | Kerfoot | B01F 3/0876 | 261/37 |
| 10,696,568 | B2 * | 6/2020 | Henderson | B01F 5/0057 | |
| 2001/0015507 | A1 | 8/2001 | Sherman et al. | | |
| 2006/0120213 | A1 * | 6/2006 | Tonkovich | B01F 5/0476 | 366/144 |
| 2010/0078372 | A1 * | 4/2010 | Kerfoot | B01F 3/0451 | 210/150 |
| 2010/0278980 | A1 * | 11/2010 | Tomasello | B01F 3/04815 | 426/231 |
| 2013/0003485 | A1 * | 1/2013 | Nakashima | A01K 63/042 | 366/101 |
| 2017/0067339 | A1 * | 3/2017 | Horlein | B05B 7/0037 | |

OTHER PUBLICATIONS

Anzaikantetsu Co, Ltd, "Micronano Bubble Generating Unit," Anzaikantetsu Co. Ltd Brochure, 2016, pp. 1-11, Japan.

* cited by examiner

NANOBUBBLE GENERATOR

PRIORITY DOCUMENTS

The present application claims priority from Australian Provisional Patent Application No. 2016904494 titled "NANOBUBBLE GENERATOR" and filed on 3 Nov. 2016, the content of which is hereby incorporated by reference in its entirety.

BACKGROUND OF THE INVENTION

The present invention relates to an apparatus for generating nanobubbles of a gas in a liquid, and in one example, to an apparatus for generating nanobubbles of ozone or oxygen that become entrained in a flow of water to thereby produce ozonated or oxygenated water.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

Gaseous nanobubbles are very small gas bubbles in liquids (e.g. water) that typically have a diameter less than 200 nanometres. Nanobubbles have no natural buoyancy and do not rise to the surface of the liquid due to their small size and negatively charged surface. Nanobubbles can therefore remain stable in liquid for a long period of time (highly efficient gas solubility), whereas macrobubbles increase in size, rise rapidly and burst at the water surface.

The utilisation of gas nanobubbles in a liquid gives rise to many applications and beneficial uses, particularly when the gas is ozone or oxygen that is dissolved in water.

Ozone ($O^3$) is known to have excellent decontamination and sanitisation properties due to its strong reactive and oxidizing properties. Ozone (in gaseous or aqueous form) is used for sanitisation purposes to kill bacteria, viruses, pathogens and other impurities. Ozone is particularly advantageous as it does not leave any chemical residues after sanitisation and simply reverts to oxygen. Ozone may therefore be used for a wide range of sanitisation purposes including, but not limited to, sanitisation of steel surfaces, in meat processing (rinsing carcasses and boned out meat cuts, plant sanitisation of machinery, conveyers, floors, chillers etc.), for clean in place purposes (e.g. cleaning floors and cutting surfaces), for operator hygiene purposes (e.g. hand and boot washing, rubber gloves etc.), sanitisation of fruit and vegetables to increase shelf life (food preservation), treatment of wastewater or stormwater run-off, for example to produce clean potable water for remote and indigenous communities and the like, sanitisation of medical facilities and equipment and any industrial, retail or commercial application where bacteria may be present and harmful to the product or environment.

The use of oxygenated water or super saturated oxygen rich water is also known to have a number of applications, including but not limited to promoting plant growth, aerating ponds, and for general use in medicine, agriculture, mining, petrochemicals, waste management and water treatment.

There are existing apparatus and systems for generating nanobubbles of ozone or oxygen in an aqueous solution, however these systems have a number of drawbacks. In particular, these systems are known to be inefficient as often multiple passes through the devices are required (i.e. recirculation of water through nanobubble generator) in order to achieve a desired concentration of the gas in solution required for it to be effective.

In other systems, it is difficult to consistently control the gas concentrations that are held in aqueous form. This can be problematic particularly for an unstable gas like ozone, as having too much ozone in solution can lead to off-gassing at unacceptable levels which presents a safety risk to operators, whilst too little ozone renders the sterilizing ability of the solution ineffective. Prior art devices are also often complex devices having moving parts that inevitably require maintenance.

Another problem with prior art devices is gas leakage which adversely affects the efficiency of the device. The level of gas in solution is therefore not as high as it should be due to the loss of leaking gas as large bubbles. As water pressure is increased with increased liquid flow rate, the gas pressure cannot be increased to compensate as gas will simply leak out around weak spots such as around fasteners and at joins etc. If an ideal gas to water pressure ratio cannot be maintained as the liquid flow rate is increased, gas dissolution and nanobubble formation both decrease which results in an inefficient system. Gas leakage therefore increases the system cost due to increased electrical costs and the need to purchase larger gas (e.g. ozone or oxygen) concentrator units.

It is against this background, and the problems and difficulties associated therewith, that the present invention has been developed.

SUMMARY OF THE PRESENT INVENTION

In one broad form, an aspect of the present invention seeks to provide an apparatus for generating nanobubbles of a gas in a liquid, the apparatus including:

a) an outer tube;

b) a porous inner tube coaxially located within the outer tube that is at least partially occluded so as to define one or more liquid flow paths through the inner tube;

c) a pair of end assemblies attached to respective first and second ends of the outer tube, each end assembly having an opening in fluid communication with the one or more liquid flow paths so as to allow a flow of liquid in an axial direction through the apparatus;

d) a gas inlet for allowing a flow of gas into a chamber formed between the outer and inner tube, the flow of gas permitted to permeate through the porous inner tube into the one or more liquid flow paths, wherein, as the gas permeates through the porous inner tube, nanobubbles of gas are generated which become entrained in the liquid flow.

In one embodiment, at least a portion of the nanobubbles are generated at a gas-liquid interface proximate an inner surface of the inner tube.

In one embodiment, the gas inlet is provided in one of:

a) a wall of the outer tube; and, b) an end assembly.

In one embodiment, the end assemblies are welded to the outer tube.

In one embodiment, the inner tube is located relative to the outer tube by sandwiching opposing ends of the inner tube between respective end assemblies.

In one embodiment, each end assembly includes a recessed or shoulder portion in which an end of the inner tube is seated.

In one embodiment, the apparatus further includes a solid rod located within the inner tube to thereby at least partially occlude the inner tube, the rod having an outer diameter less than an inner diameter of the inner tube to thereby define an annular passageway between the rod and inner tube which provides a liquid flow path.

In one embodiment, the solid rod located within the inner tube is coupled to the end assemblies.

In one embodiment, the rod is coupled to the end assemblies by a mechanical fastener at each end.

In one embodiment, the mechanical fastener is a pin, stud or all threaded rod.

In one embodiment, each end assembly includes:

a) an outer portion for attachment to the outer tube and including the opening for liquid inflow/outflow;

b) an inner portion for supporting the inner tube; and, c) an intermediate portion sandwiched between the inner and outer portions, the intermediate portion for coupling to the rod.

In one embodiment, the intermediate portion includes a body having a plurality of openings to allow passage of liquid flow between the inner and outer portions.

In one embodiment, the intermediate portion is welded to the inner and outer portions.

In one embodiment, the body of the intermediate portion includes:

a) a flow directing element extending from a first side of the body into the flow path proximate the opening of the outer portion; and, b) a boss element protruding from a second side of the body for receiving the mechanical fastener used to couple the rod to the end assembly.

In one embodiment, at least one of the inner and outer portions of the end assembly are substantially frusto-conical.

In one embodiment, the flow directing element is conical.

In one embodiment, in use, liquid flows through the opening in the outer portion of the end assembly through the plurality of openings in the intermediate portion to the inner portion of the end assembly whereby it is directed into the annular passageway between the rod and inner tube.

In one embodiment, the porous inner tube is a solid tube having a plurality of axially extending through-channels formed therein which define the one or more liquid flow paths.

In one embodiment, each end assembly includes:

a) an outer portion for attachment to the outer tube and including the opening for liquid inflow/outflow; and, b) an inner portion for supporting the inner tube and configured to direct liquid flow to or from the one or more liquid flow paths.

In one embodiment, the inner portion has a body including a plurality of through-openings corresponding to the plurality of through-channels of the porous inner tube.

In one embodiment, each end of the inner tube is in abutment with an inner portion of a respective end assembly.

In one embodiment, the inner and outer portions of the end assembly are welded together.

In one embodiment, in use, liquid flows through the opening in the outer portion of the end assembly through the plurality of through-openings of the inner portion of the end assembly whereby it is directed into the plurality of through-channels that axially extend through the inner tube.

In another broad form, an aspect of the present invention seeks to provide an apparatus for generating nanobubbles of a gas in a liquid, the apparatus including:

a) an outer tube;

b) a porous inner tube coaxially located within the outer tube so as to provide an annular passageway between the tubes, the annular passageway providing a liquid flow path;

c) a pair of end assemblies attached to respective first and second ends of the outer tube, each end assembly having an opening in fluid communication with the annular passageway so as to allow a flow of liquid in an axial direction through the apparatus;

d) a gas inlet provided in one of the end assemblies for allowing a flow of gas into the porous inner tube, the flow of gas permitted to permeate through the porous inner tube into the liquid flow path, wherein, as the gas permeates through the porous inner tube, nanobubbles of gas are generated which become entrained in the liquid flow.

In one embodiment, the end assemblies are configured to support the inner tube in position relative to the outer tube.

In one embodiment, the apparatus further includes:

a) a first end cap attached to a first end of the inner tube, the first end cap having a through-opening permitting gas flow from the gas inlet into the inner tube; and b) a second end cap attached to a second end of the inner tube, the second end cap closed to prevent gas from escaping from the second end of the inner tube.

In one embodiment, the first and second end caps are in abutment with the respective first and second ends of the inner tube.

In one embodiment, each end cap is welded to the inner tube.

In one embodiment, the end caps are seated in respective recessed or shoulder regions of the end assemblies to thereby locate the inner tube relative to the outer tube.

In one embodiment, the end assemblies are welded to the outer tube.

In one embodiment, each end assembly includes:

a) an outer portion having the opening for allowing the liquid flow into or out of the apparatus;

b) an inner portion for attachment to the outer tube; and, c) an intermediate portion sandwiched between the inner and outer portions, the intermediate portion for supporting the inner tube.

In one embodiment, the intermediate portion includes a body having a plurality of openings to allow liquid flow between the outer and inner portions.

In one embodiment, the intermediate portion is welded to the inner and outer portions.

In one embodiment, the body of the intermediate portion includes:

a) a flow directing element extending from a first side of the body into the liquid flow path proximate the opening of the outer portion of the end assembly; and, b) a recessed or shoulder portion in which an end cap attached to the inner tube is seated.

In one embodiment, at least one of the inner and outer portions of the end cap assembly are substantially frusto-conical.

In one embodiment, the flow directing element is conical.

In one embodiment, in use, liquid flows through the opening in the outer portion of the end assembly through the plurality of openings in the intermediate portion to the inner portion of the end assembly whereby it is directed into the annular passageway between the inner and outer tubes.

In one embodiment, the porous inner tube has an average pore size of between about 40 to 200 nm.

In one embodiment, the porous inner tube is one of:

a) a sintered metallic tube;

b) a porous ceramic tube; and, c) a porous plastic tube.

In one embodiment, for a sintered metallic tube, the metal is one of:

a) stainless steel;

b) brass;

c) bronze;

d) aluminium; and, e) titanium.

In one embodiment, for a porous ceramic tube, the ceramic material is one of:

a) silicon carbide;

b) alumina; and, c) titania.

In one embodiment, the outer tube is stainless steel.

In one embodiment, the solid rod is stainless steel.

In one embodiment, liquid flow through the apparatus is bi-directional.

In one embodiment, liquid flows through the apparatus without a substantial change in direction.

In one embodiment, the openings of the end assemblies are axially aligned with the outer and inner tubes.

In one embodiment, a surface area to volume ratio of the one or more liquid flow paths is substantially higher than the surface area to volume flow ratio of the inner or outer tube.

In one embodiment, the liquid is water.

In one embodiment, the gas is at least one of:

a) ozone;

b) oxygen;

c) nitrogen;

d) hydrogen; and, e) carbon dioxide.

It is to be appreciated however that other industrial gases for specialist purposes may also be used.

In another broad form, an aspect of the present invention seeks to provide an apparatus for generating nanobubbles of a gas in a liquid, the apparatus including:

a) an outer tube;

b) an internal sub-assembly housed within the outer tube and arranged to extend axially therein, the sub-assembly including:

i) a porous tube;

ii) a centre rod coaxially located within the porous tube so as to define an annular liquid flow path through the porous tube;

iii) a supporting element at each end of the porous tube, each supporting element configured to receive an end of the porous tube and configured for mounting to an end plate;

c) a pair of end plates disposed proximate opposing ends of the outer tube, the end plates mounted to the supporting elements of the sub-assembly, each end plate having one or more openings aligned with the liquid flow path through the porous tube;

d) a pair of end fittings attached to the respective ends of the outer tube so as to cover the end plates and internal sub-assembly, each end fitting having an opening in fluid communication with the liquid flow path through the porous tube via the one or more openings in a respective end plate so as to allow a flow of liquid in an axial direction through the apparatus; and, e) a gas inlet for allowing a flow of gas into a chamber formed between the outer tube and the porous tube, the flow of gas permitted to permeate through a wall of the porous tube into the liquid flow path, wherein, as the gas permeates through the wall of the porous tube, nanobubbles of gas are generated which become entrained in the liquid flow.

In one embodiment, the end plates are coupled to the centre rod by mechanical fasteners which act to support the centre rod coaxially within the porous tube.

In one embodiment, the supporting elements include a flange and a ring projecting from the flange in which the end of the porous tube is located in abutment with an internal shoulder portion of the flange, the flange having a centre opening to allow passage of liquid to and from the liquid flow path of the porous tube.

In one embodiment, the supporting element is a gas seal washer.

In one embodiment, a seal ring is sleeved over the ring of the supporting element in abutment with the flange of the supporting element.

In one embodiment, the one or more openings in each end plate are annular.

In one embodiment, the one or more openings in each end plate are discontinuous.

In one embodiment, the end fittings are conical reducers.

In yet a further broad form, an aspect of the present invention seeks to provide an apparatus for generating nanobubbles of a gas in a liquid, the apparatus including:

a) an outer tube;

b) a plurality of internal sub-assemblies housed within the outer tube and arranged to extend axially therein, each sub-assembly including:

i) a porous tube;

ii) a centre rod coaxially located within the porous tube so as to define an annular liquid flow path through the porous tube;

iii) a supporting element at each end of the porous tube, each supporting element configured to receive an end of the porous tube and configured for mounting to an end plate;

c) a pair of end plates disposed proximate opposing ends of the outer tube, the end plates mounted to the respective supporting elements of each sub-assembly and each end plate having openings that in use allow passage of liquid to and from the respective liquid flow paths of the porous tubes of each sub-assembly;

d) a pair of end fittings attached to the respective ends of the outer tube so as to cover the end plates and sub-assemblies, each end fitting having an opening in fluid communication with the liquid flow paths of each sub-assembly via the openings in a respective end plate so as to allow a flow of liquid in an axial direction through the apparatus; and, e) a gas inlet for allowing a flow of gas into a chamber formed between the outer tube and plurality of sub-assemblies, the flow of gas permitted to permeate through walls of the porous tube of each sub-assembly into the liquid flow paths, wherein, as the gas permeates through the walls of each porous tube, nanobubbles of gas are generated which become entrained in the liquid flow.

In one embodiment, the end plates are coupled to the centre rods of each sub-assembly by mechanical fasteners which act to support the centre rods co-axially within the porous tubes.

In one embodiment, the supporting elements include a flange and a ring projecting from the flange in which the end of the porous tube is located in abutment with an internal shoulder portion of the flange, the flange having a centre opening to allow passage of liquid from the liquid flow path of the porous tube.

In one embodiment, the supporting element is a gas seal washer.

In one embodiment, a seal ring is sleeved over the ring of the supporting element in abutment with the flange of the supporting element.

In one embodiment, the openings in the end plates are annular.

In one embodiment, the openings in the end plates associated with each porous tube are discontinuous.

In one embodiment, the end fittings are conical reducers.

It will be appreciated that the broad forms of the invention and their respective features can be used in conjunction, interchangeably and/or independently, and reference to separate broad forms is not intended to be limiting.

BRIEF DESCRIPTION OF THE DRAWINGS

Examples of the present invention will now be described with reference to the accompanying drawings, in which.

DETAILED DESCRIPTION OF THE PREFERRED EMBODIMENTS

Figure 1A:
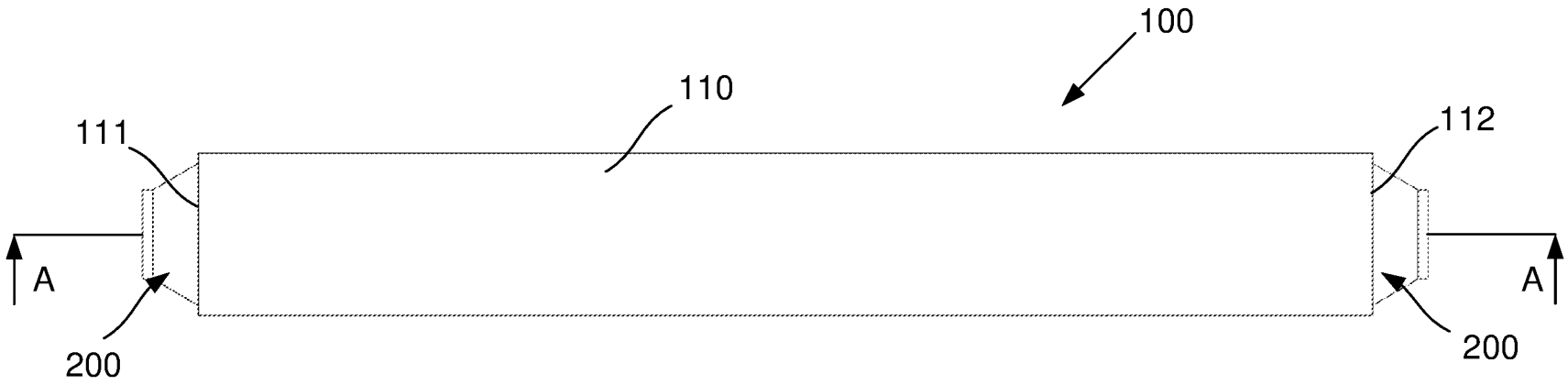
FIG. 1A is a side view of a first example of an apparatus for generating nanobubbles of a gas in a liquid.

An example of an apparatus 100 for generating nanobubbles of a gas in a liquid will now be described with reference to FIGS. 1A to 1M. For the purpose of example only, the liquid is typically water whilst the gas is selected based on the application, and for example may be ozone, oxygen, nitrogen, carbon dioxide, hydrogen or any other industrial gas for use in a specialist process.

In this example, apparatus 100 includes an outer tube 110 that forms an outer casing of the apparatus 100. A porous inner tube 120 is coaxially located within the outer tube 110, the inner tube 120 being at least partially occluded so as to define one or more liquid flow paths 104 through the inner tube 120.

A pair of end assemblies 200 are attached to respective first and second ends 111, 112 of the outer tube 110, each end assembly 200 having an opening 201, 202 in fluid communication with the one or more liquid flow paths 104 so as to allow a flow of liquid in an axial direction through the apparatus 100.

A gas inlet 115 is provided for allowing a flow of gas into a chamber 102 formed between the outer and inner tube, the flow of gas permitted to permeate through the porous inner tube 120 into the one or more liquid flow paths 104. In this regard, as the gas permeates through the porous inner tube 120, nanobubbles of gas are generated which become entrained in the liquid flow.

It will be appreciated that the above described arrangement provides a number of benefits. Firstly, by at least partially occluding the inner tube, an ideal surface area to volume ratio of the liquid flow path is able to be achieved which in turn maximises the gas to liquid transfer rate and dissolution of gaseous nanobubbles into the liquid flow. This is further assisted by the even dispersion of gas around the porous inner tube which ensures that nanobubbles are evenly formed along the length of the inner tube as the gas permeates through the pores of the inner tube to the liquid flow path. The concentration of gaseous nanobubbles in solution can therefore be increased for a given liquid flow rate through the apparatus. A further advantage of this is that higher levels of gas concentration can be achieved in a single pass of liquid through the apparatus.

By reducing the number of passes required to achieve a desired level of gas dissolution, the apparatus provides a highly efficient nanobubble generator which reduces operation time of the unit and electrical cost to produce the purified gas used in the system.

Furthermore, the above described arrangement provides a simple apparatus having no moving parts that is non-serviceable and does not require maintenance. The apparatus is further able to be assembled in a sealed manner without any mechanical fasteners (screws, bolts, washers etc.) to thereby prevent any gas from leaking out of the apparatus. Gas in the apparatus can only be injected into the liquid flow via the fine pores in the porous inner tube. Gas flow and pressure can therefore be appropriately controlled to compensate for changes in the liquid flow rate so gas dissolution can be optimised at a range of liquid flow rates.

A number of further features will now be described.

Typically, at least a portion of the nanobubbles are generated at a gas-liquid interface proximate an inner surface of the inner tube. Gas, under pressure, flows through the pores in the inner tube from the outer chamber and is injected into the one or more liquid flow paths. The nanobubbles tend to form as the gas exits the pores proximate the inner surface of the inner tube whereby they become entrained in the liquid flow. It is to be appreciated therefore that the pores of the inner tube typically have an average pore size corresponding to the size of nanobubbles that are to be generated. In one example, the average pore size is between 40 to 200 nm. In an alternative example, where gas flows inside the inner tube and water around the inner tube, the nanobubbles may be generated at a gas-liquid interface or boundary proximate an outer surface of the inner tube.

The gas inlet may be provided in either the wall of the outer tube or in one of the end assemblies, depending on the construction of the apparatus. In either example, there is single gas inlet into the apparatus to ensure that there is an even distribution of gas within or exterior to the porous inner tube so that nanobubbles are evenly formed along the length of the inner tube and across the surface area thereof. This even generation of nanobubbles assists in maximising the amount of nanobubbles that become dissolved in the liquid flow.

In order to ensure that the apparatus is effectively sealed to thereby minimise the likelihood of gas leaking out of the apparatus, the end assemblies are typically welded to the outer tube to form an integral assembly. In this way, fasteners, washers and the like are not required to assemble the unit which are typically points of failure or leakage in prior art systems.

The inner tube is located relative to the outer tube by sandwiching opposing ends of the inner tube between respective end assemblies. When the apparatus is assembled, each end of the inner tube may be in abutment with a portion of one of the end assemblies. In one example, each end assembly includes a recessed or shoulder portion in which an end of the inner tube is seated and axially restrained.

The inner tube may be at least partially occluded in several ways in order to define the one or more liquid flow paths. In one example, the apparatus further includes a solid rod located within the inner tube to thereby at least partially occlude the inner tube, the rod having an outer diameter less than an inner diameter of the inner tube to thereby define an annular passageway between the rod and inner tube which provides a liquid flow path. By occluding the inner tube, the cross sectional area (and therefore volume) of the flow path is reduced (in comparison to the cross-sectional area and volume of the inner tube itself) while the surface area of the gas-liquid interface (inner surface of the inner tube) remains constant. The surface area to volume ratio of the liquid flow path is therefore able to be increased to thereby maximise the concentration of nanobubbles in each mL of liquid flowing through the apparatus, resulting in optimal gas to water transfer rate.

The solid rod located within the inner tube is typically coupled to the end assemblies in order to maintain its position with respect to the inner tube. In one example, the rod is coupled to the end assemblies by a mechanical fastener at each end, which may for example be a pin, stud or all threaded rod. In this regard, an all threaded rod may be threadedly engaged into a threaded aperture in one end of the solid rod and into a threaded aperture in a portion of the end assembly.

In one example, each end assembly includes an outer portion for attachment to the outer tube and including the opening for liquid inflow/outflow, an inner portion for supporting the inner tube, and an intermediate portion sandwiched between the inner and outer portions, the intermediate portion for coupling to the rod. Typically, the intermediate portion is welded to the inner and outer portions to ensure that no gas is able to leak out of the apparatus through the end assemblies.

The intermediate portion includes a body having a plurality of openings to allow passage of liquid flow between the inner and outer portions. The body of the intermediate portion may further include a flow directing element extending from a first side of the body into the flow path proximate the opening of the outer portion, and, a boss element protruding from a second side of the body for receiving the mechanical fastener used to couple the rod to the end assembly. The flow directing element is typically conical such that liquid flow strikes the tapered conical walls which act to direct the flow to/from the annular liquid flow path. At least one of the inner and outer portions of the end assembly are substantially frusto-conical, at least in part to assist in directing flow through the end assembly between the opening (i.e. liquid inlet/outlet) and liquid flow path through the porous inner tube.

In use, at an inlet end assembly, liquid flows through the opening (i.e. inlet) in the outer portion of the inlet end assembly through the plurality of openings in the intermediate portion to the inner portion of the inlet end assembly whereby it is directed into the annular passageway between the rod and inner tube. At an outlet end assembly, a gas-liquid solution flows into the inner portion of the outlet end assembly, through the plurality of openings in the intermediate portion before exiting the apparatus at the opening (i.e. outlet) of the outer portion of the end assembly. It is to be appreciated that liquid flow the apparatus can be bi-directional so either end assembly could be the inlet/outlet depending on the direction of flow through the apparatus.

Another way of occluding the inner tube so as to the increase the surface area to volume ratio of the one or more liquid flow paths is to provide a porous inner tube that is a solid tube having a plurality of axially extending through-channels formed therein which define the one or more liquid flow paths (as distinct from the annular liquid flow path described in the previous example).

In such an arrangement, each end assembly typically includes an outer portion for attachment to the outer tube and including the opening for liquid inflow/outflow, and, an inner portion for supporting the inner tube and configured to direct liquid flow to or from the one or more liquid flow paths.

In one example, the inner portion has a body including a plurality of through-openings corresponding to the plurality of through-channels of the porous inner tube which act to direct flow through the end assembly into the flow paths in the porous inner tube.

The inner portion of the end assembly may support the inner tube in any suitable manner. In one example, each end of the inner tube is in abutment with an inner portion of a respective end assembly. The inner portion of the end assembly may have a recessed or shoulder region adapted to seat an end of the inner tube.

Typically, the inner portion of the end assembly is welded to the outer portion to ensure that no gas is able to leak out of the apparatus through the end assemblies.

In use, at an inlet end assembly, liquid flows through the opening (i.e. inlet) in the outer portion of the inlet end assembly through the plurality of through-openings in the inner portion of the inlet end assembly whereby it is directed into the plurality of through-channels that axially extend through the inner tube. At an outlet end assembly, a gas-liquid solution flows into the plurality of through-openings in the inner portion of the outlet end assembly, before exiting the apparatus at the opening (i.e. outlet) of the outer portion of the outlet end assembly.

In an alternative example, there is provided an apparatus for generating nanobubbles of a gas in a liquid having an outer tube and a porous inner tube coaxially located within the outer tube so as to provide an annular passageway between the tubes, the annular passageway providing a liquid flow path. A pair of end assemblies are attached to respective first and second ends of the outer tube, each end assembly having an opening in fluid communication with the annular passageway so as to allow a flow of liquid in an axial direction through the apparatus. A gas inlet is provided in one of the end assemblies for allowing a flow of gas into the porous inner tube, the flow of gas permitted to permeate through the porous inner tube into the liquid flow path, wherein, as the gas permeates through the porous inner tube, nanobubbles of gas are generated which become entrained in the liquid flow.

It is to be appreciated therefore that in this example, gas flows through the porous inner tube and permeates or disperses out of the inner tube into a liquid flow that surrounds the porous inner tube. In the previous examples, liquid flows through the porous inner tube and gas disperses into the porous inner tube from an outer gas-filled chamber.

In this example, the end assemblies are configured to support the inner tube in position relative to the outer tube. In this regard, the apparatus further includes a first end cap attached to a first end of the inner tube, the first end cap having a through-opening permitting gas flow from the gas inlet into the inner tube, and a second end cap attached to a second end of the inner tube, the second end cap closed to prevent gas from escaping from the second end of the inner tube. In this way, gas is only permitted to exit the inner tube through the porous wall which increases efficiency of the apparatus in generating nanobubbles.

The first and second end caps are typically in abutment with the respective first and second ends of the inner tube and in one example each end cap is welded to the inner tube.

The end caps themselves may be seated in respective recessed or shoulder regions of the end assemblies to thereby locate and fix the inner tube relative to the outer tube.

As described in respect of previous examples, the end assemblies are typically welded to the outer tube to form an integral unit which prevents leakage of gas flow and pressure.

Each end assembly typically includes an outer portion having the opening for allowing the liquid flow into or out of the apparatus, an inner portion for attachment to the outer tube, and, an intermediate portion sandwiched between the inner and outer portions, the intermediate portion for supporting the inner tube. The intermediate portion includes a body having a plurality of openings to allow liquid flow between the outer and inner portions and typically the intermediate portion is welded to the inner and outer portions to form a sealed end assembly.

The body of the intermediate portion may additionally include a flow directing element extending from a first side of the body into the liquid flow path proximate the opening of the outer portion of the end assembly, and, a recessed or shoulder portion in which an end cap attached to the inner tube is seated. The flow directing element and inner and outer portions may be respectively conical and frusto-conical as described with respect to previous examples.

In the above example, in use, at an inlet end assembly, liquid flows through the opening in the outer portion of the inlet end assembly through the plurality of openings in the intermediate portion to the inner portion of the inlet end assembly whereby it is directed into the annular passageway between the inner and outer tubes. At an outlet end assembly, a gas-liquid solution flows into the inner portion, through the plurality of openings in the intermediate portion and into the outlet portion before exiting the apparatus.

In the above described examples, typically the end assemblies and specifically the openings which provide the liquid inlet/outlet are axially aligned with the outer tube and porous inner tube to provide a compact in-line arrangement that provides for ease of installation and fitment with pipes or hoses, particularly if space is limited.

As previously mentioned, the porous inner tube typically has an average pore size of between about 40 to 200 nm, in order to promote the formation of nanobubbles (as opposed to microbubbles or even larger bubbles which are inherently more unstable in solution and that quickly rise to the surface). The porous inner tube may be formed of any suitable material, but typically one of a sintered metallic tube, a porous ceramic tube, and, a porous plastic tube. For a sintered metallic tube, the metal could be one of stainless steel, brass, bronze, aluminium, and, titanium. For a porous ceramic tube, the material is preferably silicon carbide, although alumina and titania could also be used. The material may be selected depending on the type of gas being used. If an oxidising gas such as ozone is to be used, then using stainless steel, titanium or silicon carbide would be appropriate selections. Other metals and plastics could however be used with non-oxidising gases such as oxygen, nitrogen etc.

The outer tube (and solid rod if used) would both typically be made from stainless steel (e.g. grade 316L), which is a particularly suitable material due to its corrosion resistance and strength.

In a further example, the apparatus is configured to be modular to therefore permit scalability of the unit which allows various flow rates to be achieved, making it suitable for any industry. In such an example, the apparatus may include an outer tube and an internal sub-assembly housed within the outer tube and arranged to extend axially therein, the sub-assembly including a porous tube; a centre rod coaxially located within the porous tube so as to define an annular liquid flow path through the porous tube; and, a supporting element at each end of the porous tube, each supporting element configured to receive an end of the porous tube and configured for mounting to an end plate. A pair of end plates are disposed proximate opposing ends of the outer tube, the end plates mounted to the supporting elements of the sub-assembly, each end plate having one or more openings aligned with the liquid flow path through the porous tube. A pair of end fittings are attached to the respective ends of the outer tube so as to cover the end plates and internal sub-assembly, each end fitting having an opening in fluid communication with the liquid flow path through the porous tube via the one or more openings in a respective end plate so as to allow a flow of liquid in an axial direction through the apparatus. A gas inlet is also provided for allowing a flow of gas into a chamber formed between the outer tube and the porous tube, the flow of gas permitted to permeate through a wall of the porous tube into the liquid flow path, wherein, as the gas permeates through the wall of the porous tube, nanobubbles of gas are generated which become entrained in the liquid flow.

The modularity of the above-described design enables larger units to be constructed simply by housing multiple internal sub-assemblies within a larger outer tube and by mounting the plurality of internal sub-assemblies to custom end plates.

The apparatus 100 shown in FIGS. 1A to 1M shall now be described in further detail.

In this example, the apparatus 100 includes an outer tube 110 that is welded at ends 111, 112 thereof to a pair of end assemblies 200 along weld lines 204. These welds seal the apparatus 100 to prevent gas leakage and obviate the need for mechanical fasteners and the like to assemble the unit. In this way, the apparatus 100 is a fully-sealed, non-serviceable unit. In this example, the outer tube 110 is 316L stainless steel pipe, although any suitable material with corrosion resistant properties may be used such as 304 stainless steel and titanium. A plastic such as PTFE (Teflon) may also be suitable but the non-weldability of this material would require the end assemblies to be fixed using a non-welding process.

A porous inner tube 120 is coaxially located within the outer tube 110 and is at least partially occluded by a solid centre rod 130 which extends axially through the inner tube 120. The centre rod 130 has a smaller diameter than an internal diameter of the inner tube 120 so that an annular passageway 104 is provided between the rod and inner tube which defines a liquid flow path. In this example, the centre rod is 316L stainless steel and the porous inner tube is silicon carbide.

Each end assembly 200 has an opening 201, 202 which acts as the liquid inlet or outlet (depending on direction of flow into the apparatus). The inlet/outlet 201, 202 are in fluid communication with the annular passageway 104 so as to allow a flow of liquid in an axial direction through the apparatus 100.

Figure 1B:
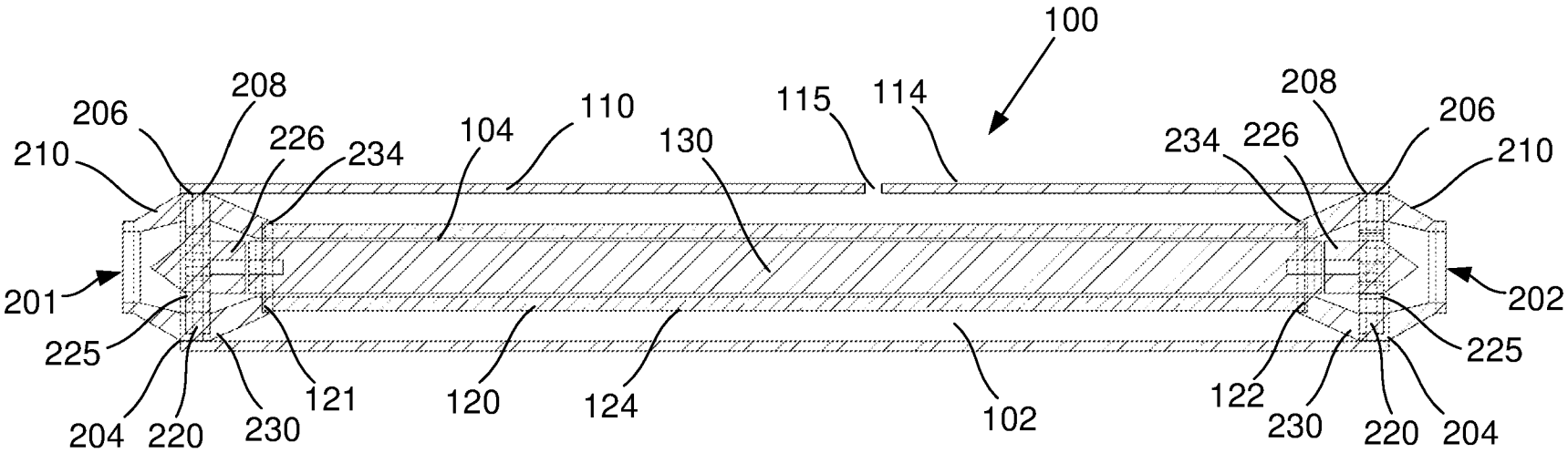
FIG. 1B is a sectional view of the apparatus taken through section A-A of FIG. 1A.
Figure 1C:
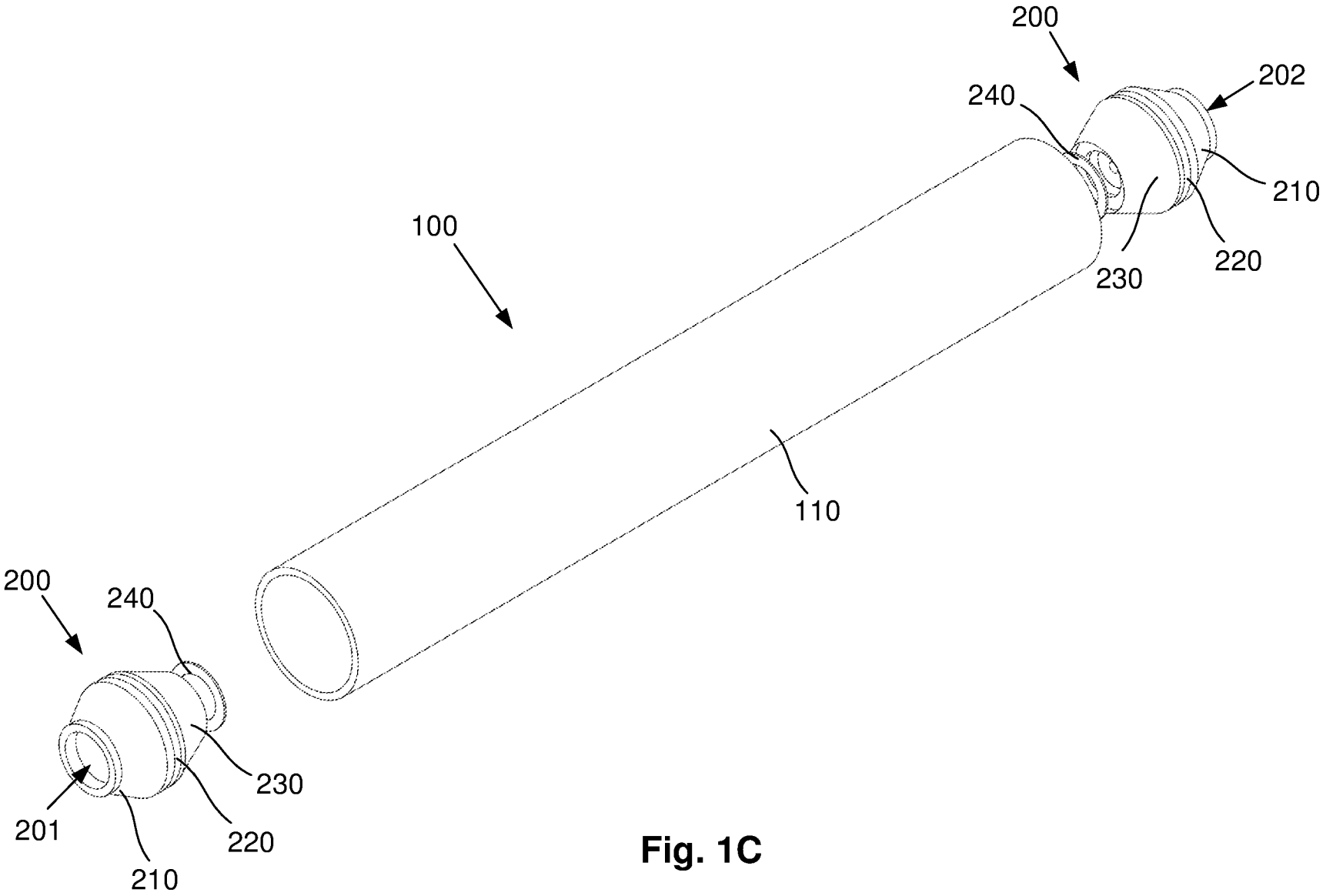
FIG. 1C is a partially exploded perspective view of the apparatus of FIG. 1A.
Figure 1D:
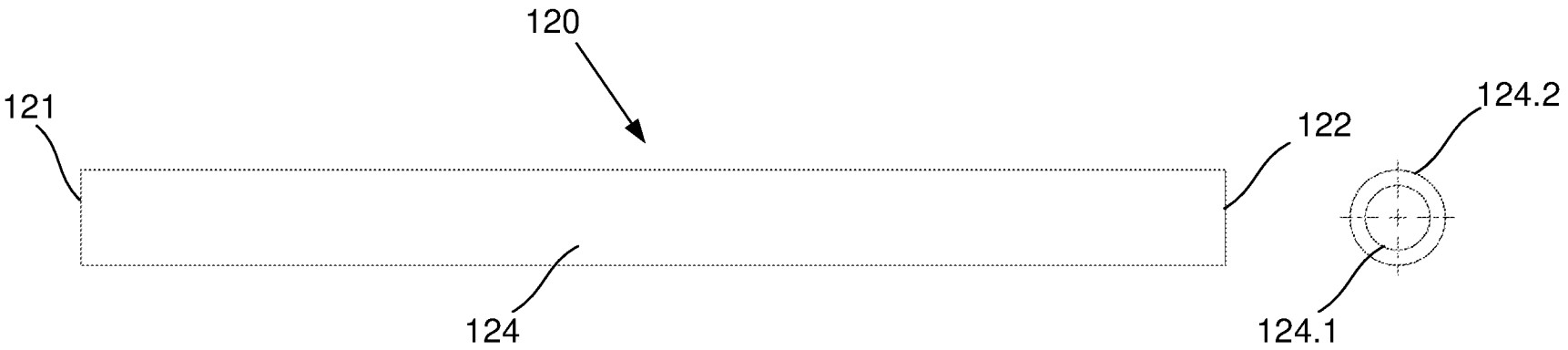
FIG. 1D is a side and end view of a porous inner tube of the apparatus of FIG. 1A.
Figure 1E:
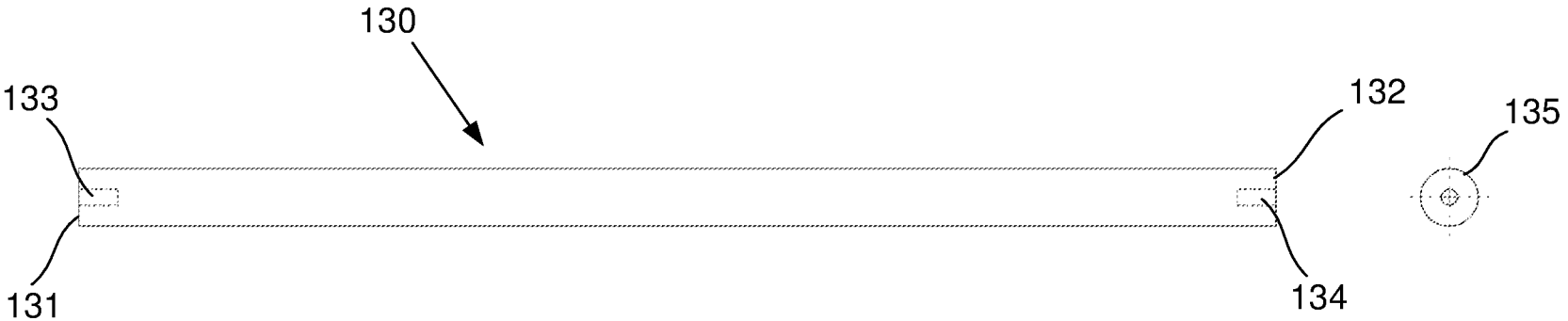
FIG. 1E is a side and end view of a rod that at least partially occludes the porous inner tube of the apparatus of FIG. 1A.
Figure 1F:
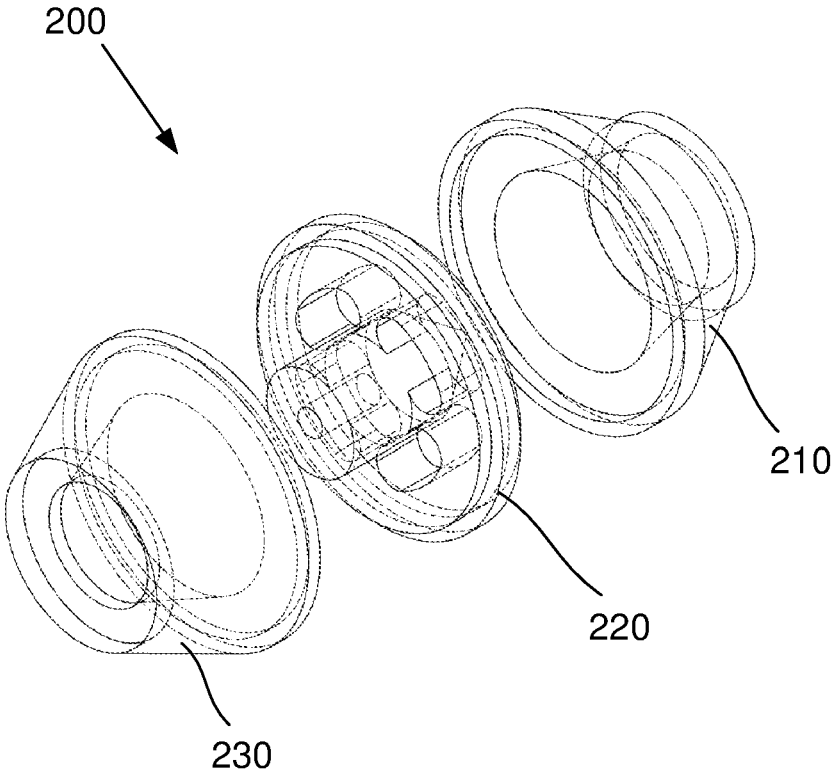
FIG. 1F is an exploded view of an end assembly of the apparatus of FIG. 1A.
Figure 1G:
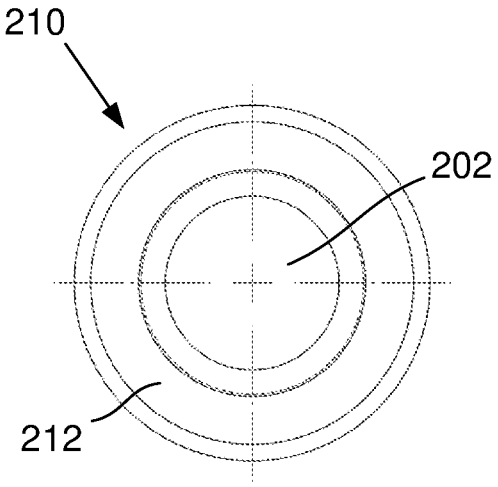
FIG. 1G is an end view of an outer portion of the end assembly of the apparatus of FIG. 1A.
Figure 1H:
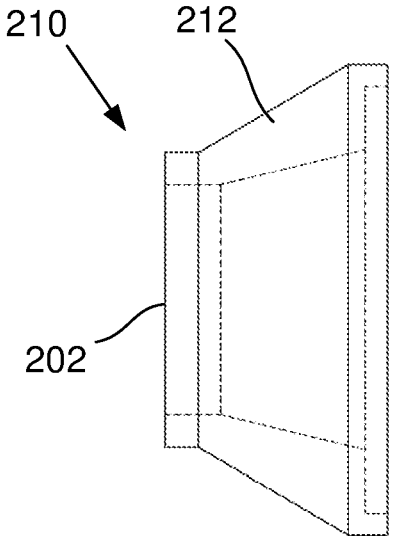
FIG. 1H is a side view of the outer portion of the end assembly of the apparatus of FIG. 1A.
Figure 1I:
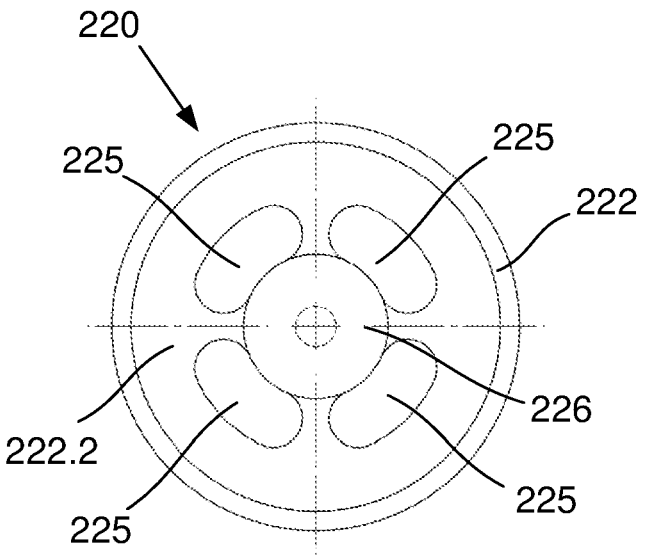
FIG. 1I is an end view of an intermediate portion of the end assembly of the apparatus of FIG. 1A.
Figure 1J:
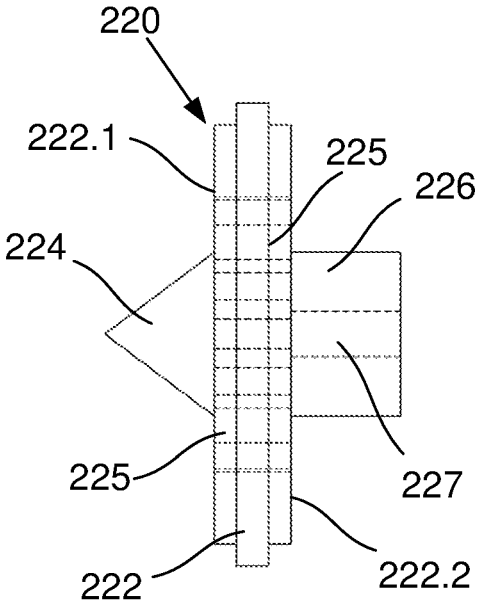
FIG. 1J is a side view of the intermediate portion of the end assembly of the apparatus of FIG. 1A.
Figure 1K:
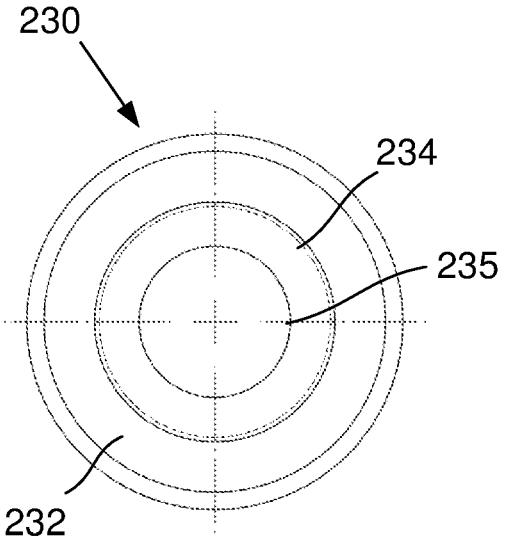
FIG. 1K is an end view of an inner portion of the end assembly of the apparatus of FIG. 1A.
Figure 1L:
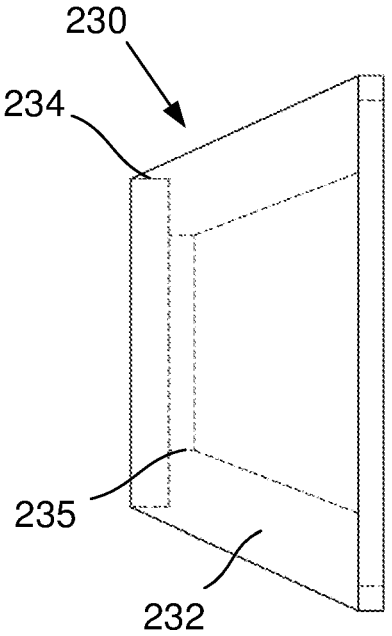
FIG. 1L is a side view of the inner portion of the end assembly of the apparatus of FIG. 1A.
Figure 1M:
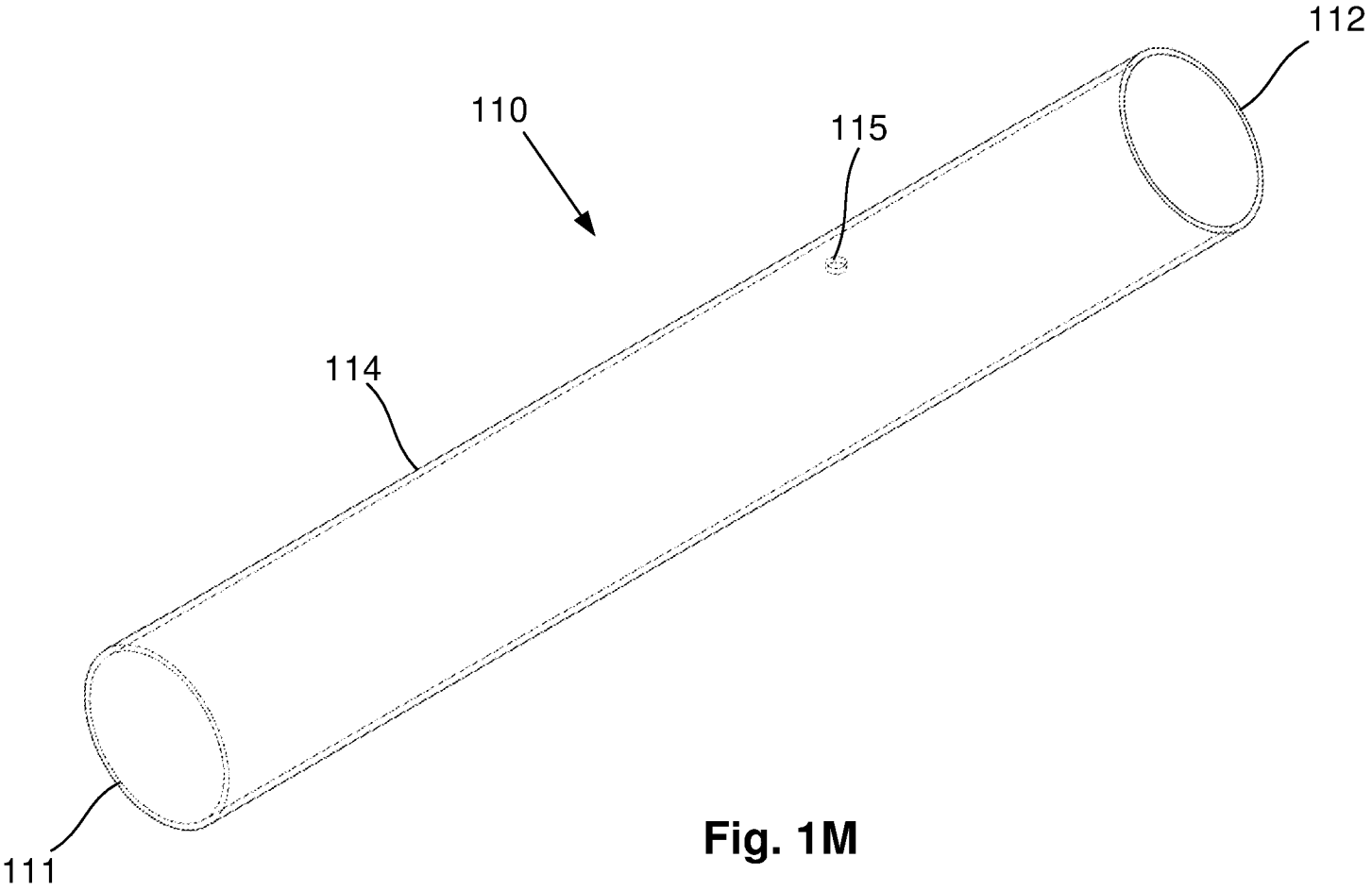
FIG. 1M is a perspective view of the outer tube of the apparatus of FIG. 1A.

A gas inlet 115 for allowing a flow of gas into a chamber 102 formed between the outer and inner tube is provided in the wall 114 of the outer tube 110 as shown for example in FIGS. 1B and 1M. In use, the flow of pressurized gas in the chamber 102 permeates or disperses through the wall of the porous inner tube into the annular flow path 104. As the gas permeates through the porous inner tube, nanobubbles of gas are generated which become entrained in the liquid flow. The nanobubbles are typically formed proximate the inner surface of the porous tube as the gas exits the pores and is sheared by the liquid flow (i.e. at a gas-liquid interface or boundary). In this way, the nanobubbles are formed due to a shearing effect as they exit the porous tube which prevents them from becoming a micro or macro bubble.

In this example, the end assemblies 200 comprise an outer portion 210 having a substantially frusto-conical body 212 that is welded to an intermediate portion 220 along weld line 206. The intermediate portion 220 is in turn welded to an inner portion 230 having a substantially frusto-conical body 232. Each inner portion 230 includes a recessed shoulder 234 that is in abutment with a respective end 121, 122 of the porous inner tube 120 which is effectively sandwiched between inner portions 230 of opposing end assemblies 200. A viton washer 240 or the like may be used between the recessed shoulder 234 and ends 121, 122.

The intermediate portion 220 (as shown in more detail in FIGS. 1I and 1J) includes a body 222 which has a plurality of radially spaced apart channels (slots or apertures) 225 through which liquid flow is able to pass. The body 222 includes a flow directing element 224 extending from a first side 222.1 of the body 222 into the flow path proximate the opening 201 of the outer portion 210. A boss element 226 protrudes from a second side 222.2 of the body 222 for receiving a mechanical fastener (not shown) used to couple the centre rod 130 to the end assembly 200. In this regard, the centre rod 130 includes a first threaded aperture 133 at a first end 131 and a second threaded aperture 134 at a second end 132 which receive part of a fastener such as an all-threaded rod which is threadedly engaged at an opposing end into a threaded aperture 227 formed in the boss element 226 of the intermediate portion 220.

In this way, the centre rod 130 is fixed relative to the inner tube 120 in order to maintain the annular spacing between the two components which provides the liquid flow path and ensures an optimal surface area to volume ratio of the flow path which assists in maximising the dissolution of gas nanobubbles into the liquid.

A second example of an apparatus 300 for generating nanobubbles of a gas in a liquid shall now be described with reference to FIGS. 2A to 2D.

In this example, the apparatus 300 includes an outer tube 310 that is welded at ends 311, 312 thereof to a pair of end assemblies 400 along weld lines 404. These welds seal the apparatus 400 to prevent gas leakage and obviate the need for mechanical fasteners and the like to assemble the unit. In this way, the apparatus 300 is a fully-sealed, non-serviceable unit similar to previously described apparatus 100. In this example, the outer tube 310 is 316L stainless steel pipe, although any suitable material with corrosion resistant properties may be used.

A porous inner tube 320 is coaxially located within the outer tube 310 and is supported between the opposing end assemblies 400 (for example in recessed or shoulder portions thereof). In this example, the porous inner tube 320 is a solid tube having a plurality of axially extending through-channels 324 formed therein which extend between opposing ends 326, 327 of the tube. The channels 324 form narrow liquid flow paths having a surface area to volume ratio suitable for optimisation of gas to liquid transfer which in turn maximises the concentration of gas nanobubbles in solution. In this example, the porous inner tube is silicon carbide, although a sintered stainless steel or porous plastic could also be used.

Each end assembly 400 has an opening 401, 402 which acts as the liquid inlet or outlet (depending on direction of flow into the apparatus). The inlet/outlet 401, 402 are in fluid communication with the plurality of liquid flow paths 324 so as to allow a flow of liquid in an axial direction through the apparatus 300.

A gas inlet (not shown) for allowing a flow of gas into a chamber 302 formed between the outer and inner tube is provided in the wall of the outer tube 310. In use, the flow of pressurized gas in the chamber 302 permeates or disperses through the porous inner tube into the plurality of flow paths formed by the through-channels 324. As the gas permeates through the porous inner tube into the channels 324, nanobubbles of gas are generated which become entrained in the liquid flow. The nanobubbles are typically formed along the inner surface of the channels 324 as the gas exits the pores and contacts the liquid (i.e. at a gas-liquid interface).

In this example, the end assemblies 400 comprise an outer portion 410 having a substantially frusto-conical body that is welded to an inner portion 420 along weld line 406. The inner portion 420 includes a body having a plurality of channels or apertures 422 which correspond to the plurality of axially extending through-channels of the inner tube 420 to thereby direct the flow of liquid from the opening 401,402 into the liquid flow paths formed in the inner tube 320.

Figure 2A:
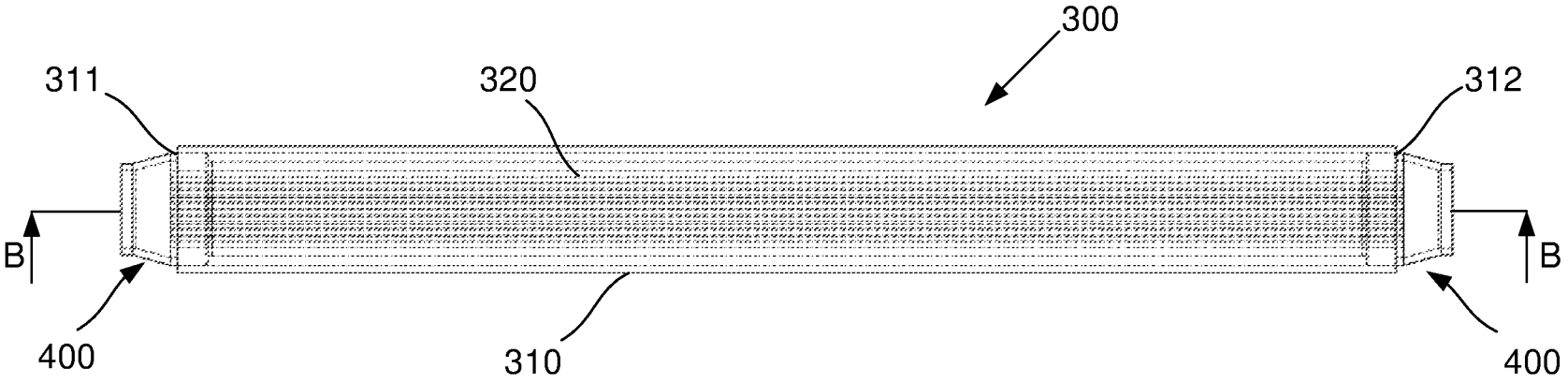
FIG. 2A is a side view of a second example of an apparatus for generating nanobubbles of a gas in a liquid.
Figure 2B:
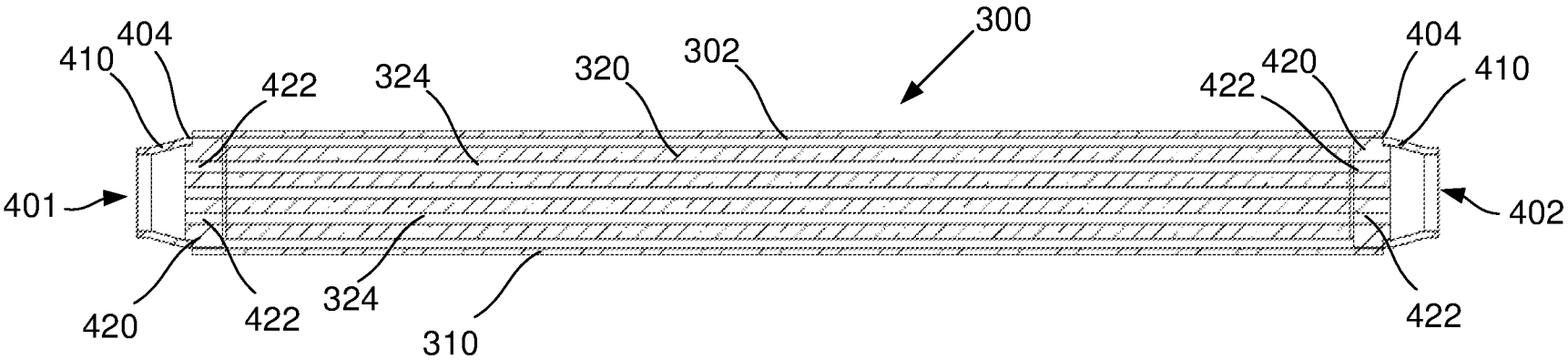
FIG. 2B is a sectional view of the apparatus taken through section B-B of FIG. 2A.
Figure 2C:
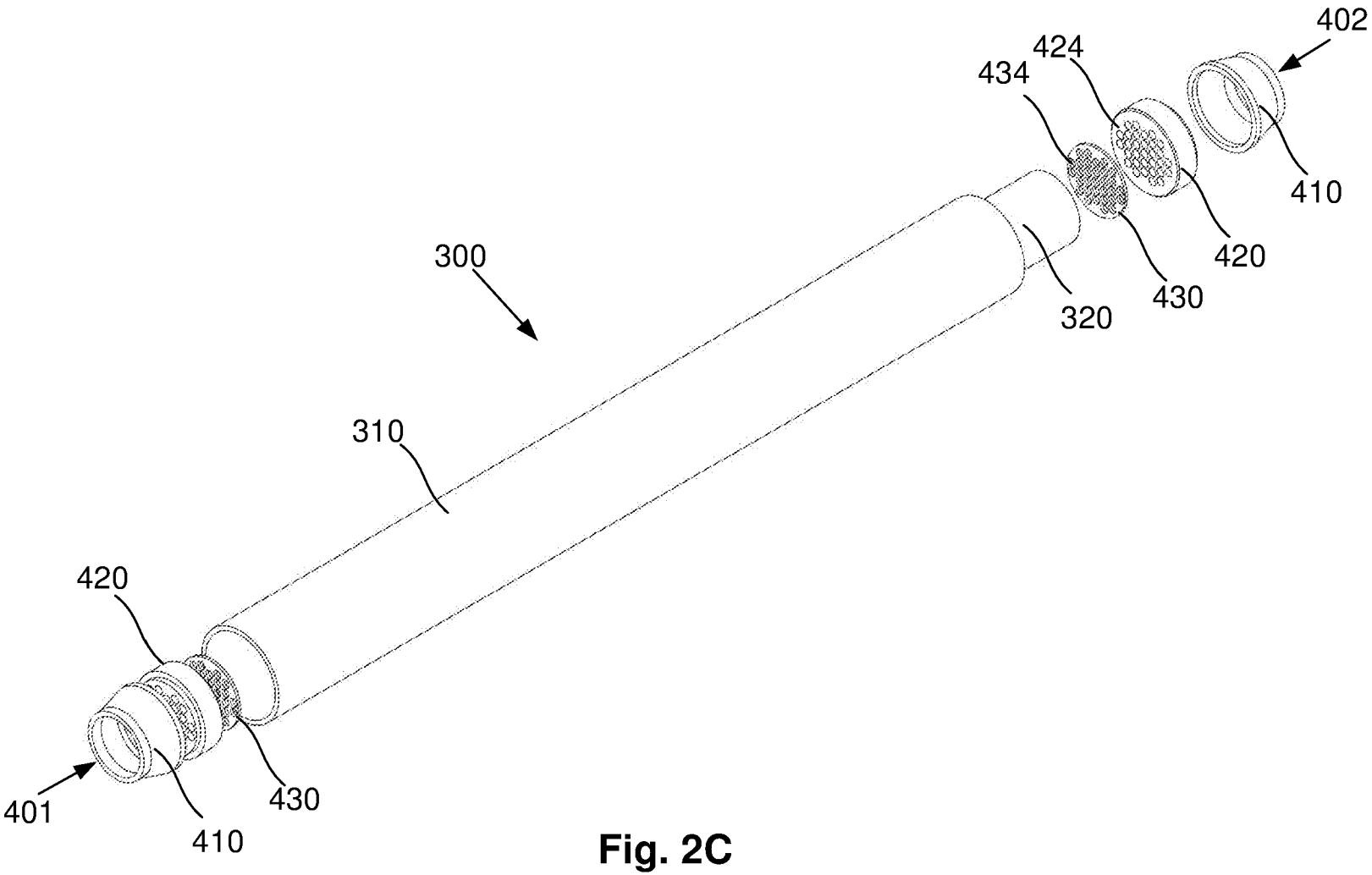
FIG. 2C is an exploded perspective view of the apparatus of FIG. 2A.
Figure 2D:
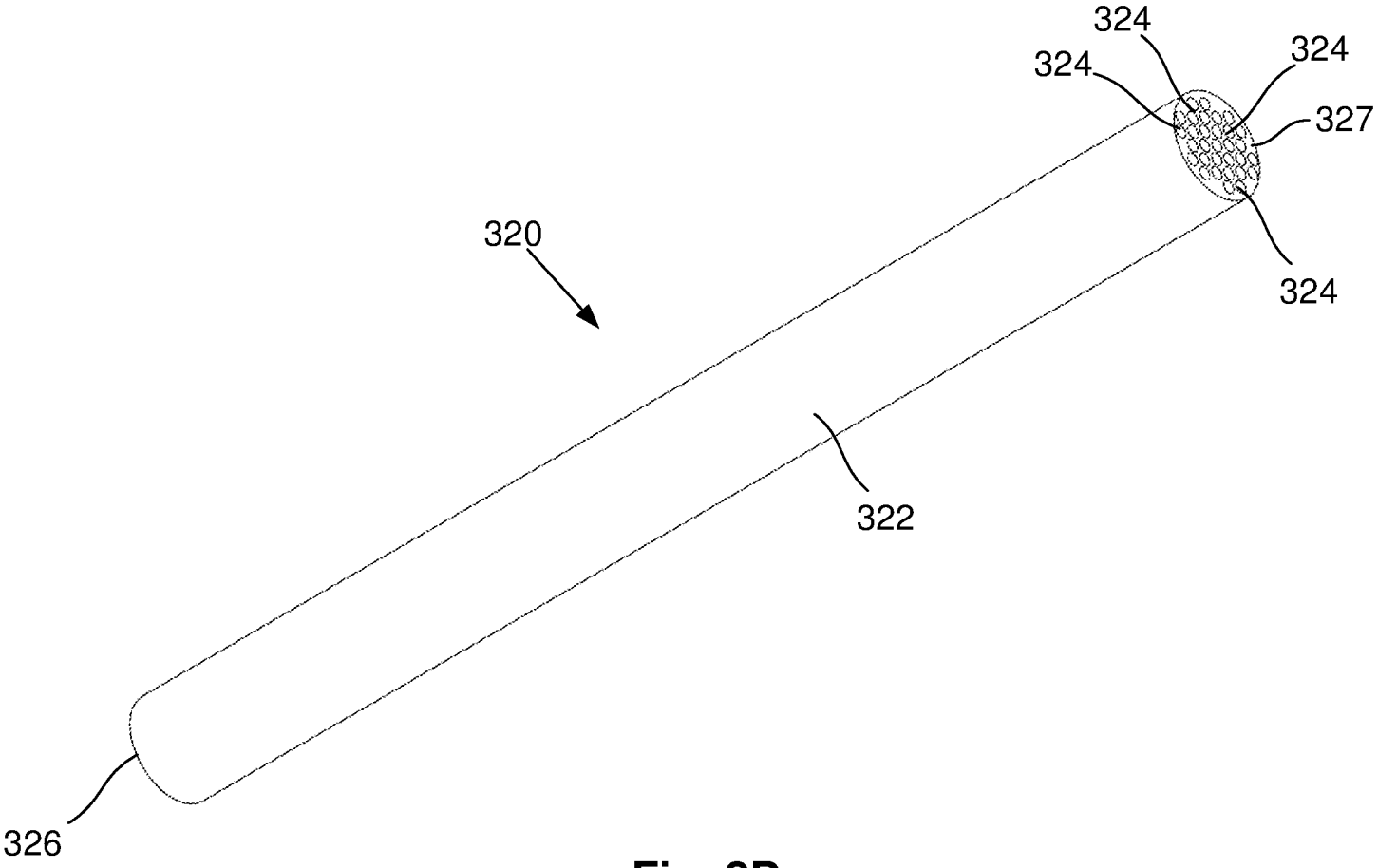
FIG. 2D is a perspective view of the porous inner tube of the apparatus of FIG. 2A.

As previously described, the porous inner tube 320 is sandwiched between the opposing end assemblies 400, typically having ends that are seated in recessed or shoulder regions of the inner portion 420 of the end assembly 400. As shown in FIG. 2C, a washer 430 having corresponding apertures 434 to the through-channels 324 may be disposed between the ends of the inner tube and inner portion 420 of each end assembly 400.

A third example of an apparatus 500 for generating nanobubbles of a gas in a liquid shall now be described with reference to FIGS. 3A to 3G.

In this example, the apparatus 500 includes an outer tube 510 that is welded to a pair of end assemblies 600, 600' along weld lines 604, 604'. These welds seal the apparatus 500 to prevent gas leakage and obviate the need for mechanical fasteners and the like to assemble the unit. In this way, the apparatus 500 is a fully-sealed, non-serviceable unit similar to previously described examples. In this example, the outer tube 510 is 316L stainless steel pipe, although any suitable material with corrosion resistant properties may be used.

A porous inner tube 520 is coaxially located within the outer tube 510 so as to provide an annular passageway 502 between the respective tubes which provides a liquid flow path. In this example, the porous inner tube 520 is made from sintered stainless steel. Each end assembly 600, 600' has an opening 601, 601' in fluid communication with the annular passageway 502 so as to allow a flow of liquid in an axial direction through the apparatus 500.

A gas inlet 625 is provided in end assembly 600 for allowing a flow of gas into the porous inner tube 520, the flow of gas permitted to permeate through the porous inner tube 520 into the liquid flow path defined by the annular passageway 502. As the gas permeates through the porous inner tube 520, nanobubbles of gas are generated which become entrained in the liquid flowing through the annular passageway 502.

The end assemblies 600, 600' are configured to support the inner tube 520 in fixed position relative to the outer tube 510. In this regard, the apparatus 500 includes a first end cap 530 attached to a first end 521 of the inner tube 520, the first end cap 530 having a through-opening 532 permitting gas flow from the gas inlet 625 into the inner tube 520. A second end cap 540 is attached to a second end 522 of the inner tube 520, the second end cap 540 closed to prevent gas from escaping from the second end 522 of the inner tube 520. The ends 521, 522 of the inner tube 520 are typically welded to mating ends 533, 543 of the respective end caps 530, 540.

Each end assembly 600, 600' includes an outer portion 610, 610' having the openings 601, 601' for allowing the liquid flow into or out of the apparatus 500, an inner portion 630, 630' for attachment to the outer tube 510 and an intermediate portion 620, 620' sandwiched between the inner and outer portions, the intermediate portion 620, 620' for supporting the inner tube.

The end caps 530, 540 attached to the inner tube 520 are seated in respective recessed or shoulder regions 628, 628' of the intermediate portions 620, 620' of the end assemblies 600, 600' to thereby locate the inner tube 520 relative to the outer tube 510.

Figure 3A:
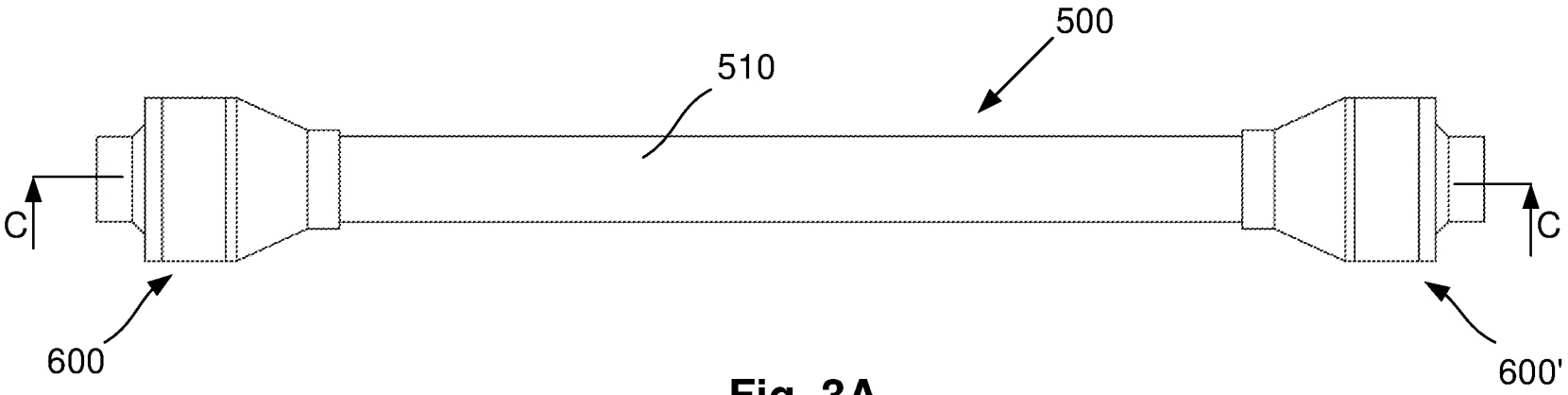
FIG. 3A is a side view of a third example of an apparatus for generating nanobubbles of a gas in a liquid.
Figure 3B:
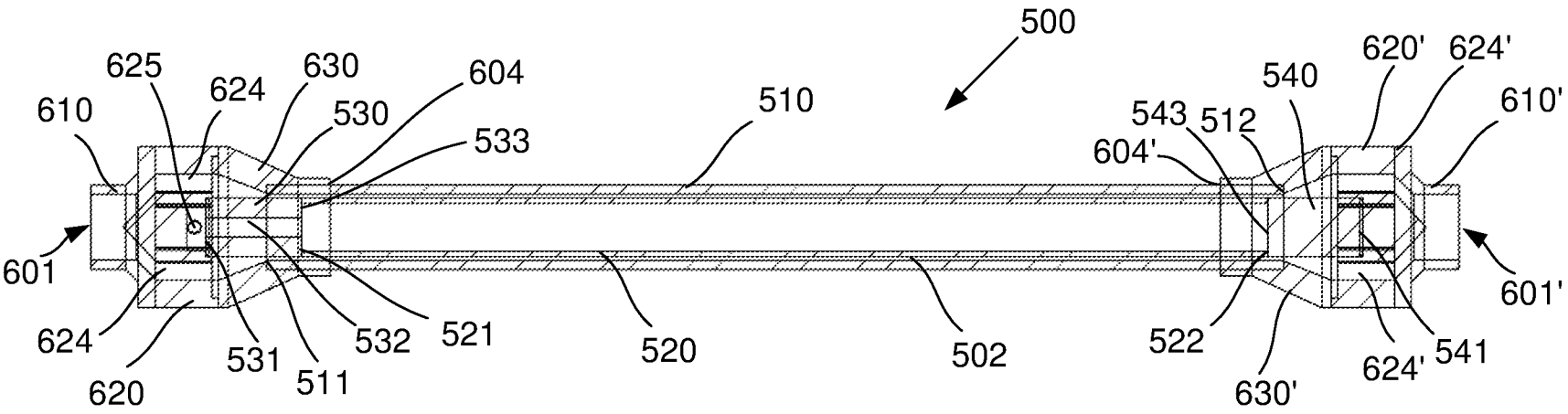
FIG. 3B is a sectional view of the apparatus taken through section C-C of FIG. 3A.
Figure 3C:
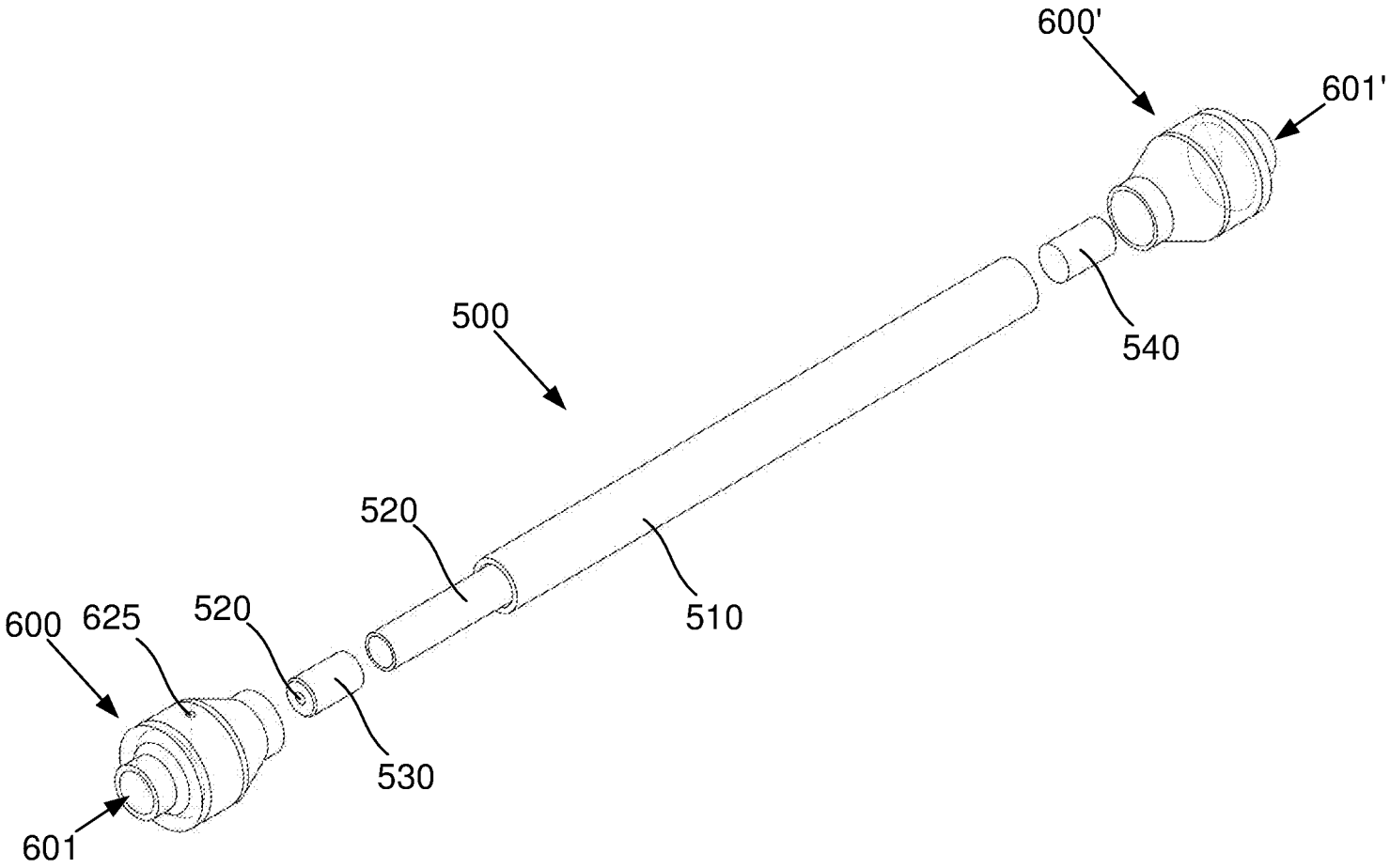
FIG. 3C is a partially exploded perspective view of the apparatus of FIG. 3A.
Figure 3D:
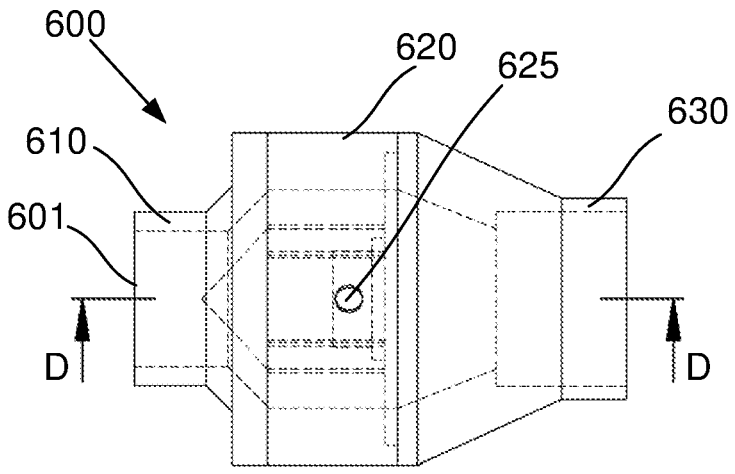
FIG. 3D is a side view of an end assembly of the apparatus of FIG. 3A which provides a gas inlet.
Figure 3E:
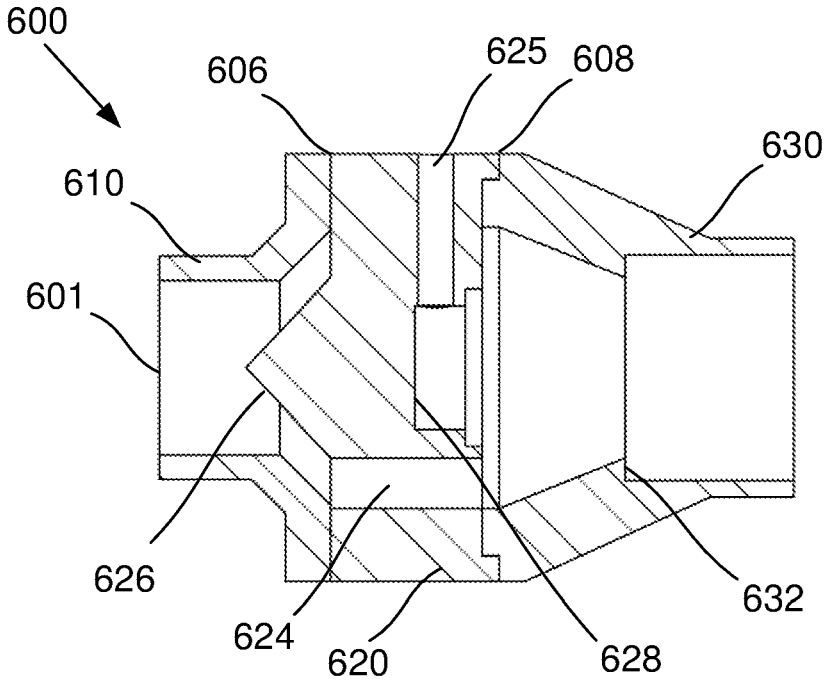
FIG. 3E is a sectional view of the end assembly taken through section D-D of FIG. 3D.

Referring now to FIGS. 3D and 3E, the end assembly 600 having the gas inlet 625 is shown in further detail. As shown, the intermediate portion 620 is welded to the inner and outer portions via respective welds 606, 608 to ensure that gas does not leak out of the end assembly 600. The intermediate portion 620 includes a body having one or more channels 624 to allow passage of liquid between the opening 601 and the inner portion 630 of the end assembly 600 whereby it is directed into the annular passageway between the inner and outer tubes. The inner portion 630 includes a recessed or shoulder portion 632 upon which an end of the outer tube is seated when the apparatus 500 is assembled.

The body of the intermediate portion 620 further includes a conical flow directing element 626 extending from a first side of the body into the liquid flow path proximate the opening 601 of the outer portion 610 of the end assembly 610, and the recessed or shoulder portion 628 in which the end cap 530 attached to the inner tube 520 is seated. At the gas insertion end of the apparatus, end cap 530 is welded to the recessed or shoulder portion 628 of the intermediate portion 620 of the end assembly 600.

Figure 3F:
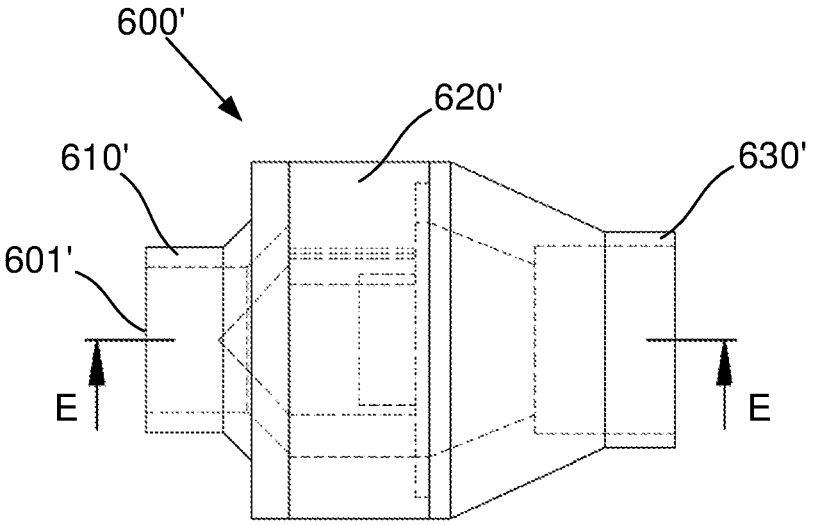
FIG. 3F is a side view of an end assembly of the apparatus of FIG. 3A provided at an opposite end to the gas inlet.
Figure 3G:
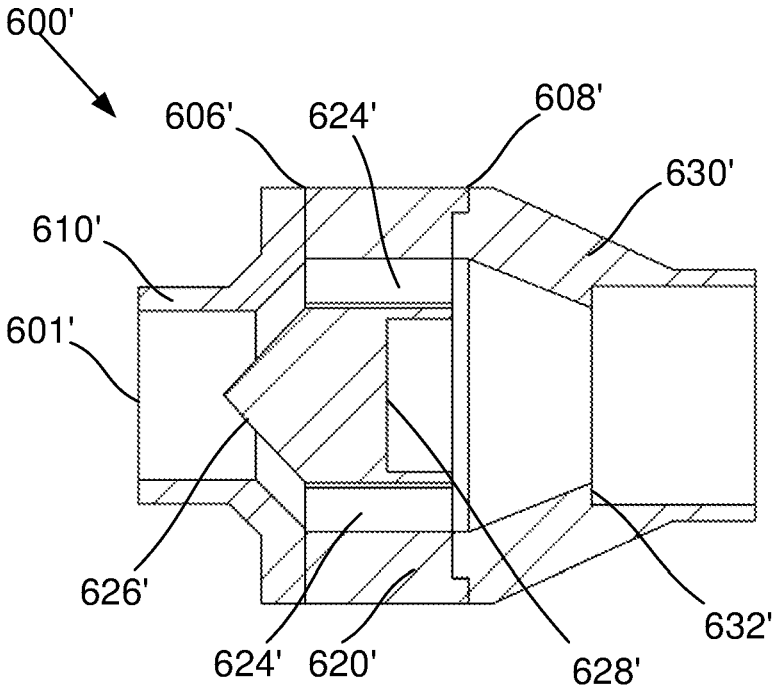
FIG. 3G is a sectional view of the end assembly taken through section E-E of FIG. 3F.

The end assembly 600' without the gas inlet is shown in further detail in FIGS. 3F and 3G. In these figures, corresponding reference numerals relate to corresponding features previously described with respect to end assembly 600 and for brevity shall not be described again. In this end assembly 600', the end cap 540 seated in recess or shoulder region 628' is not welded to the end assembly as gas does not enter this part of the apparatus.

Figure 4:
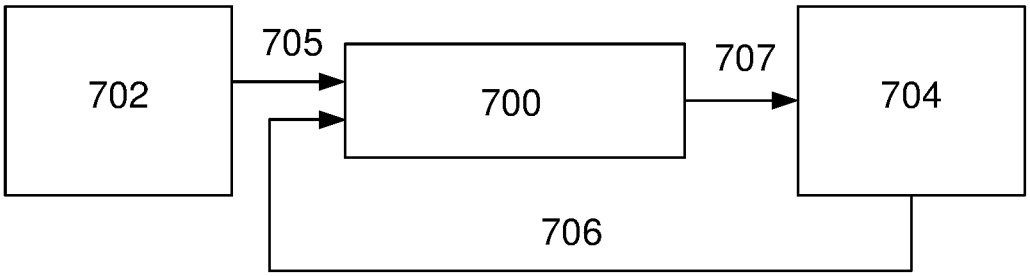
FIG. 4 is a simplified schematic block diagram of a system for generating nanobubbles of a gas in a liquid.
Figure 5A:
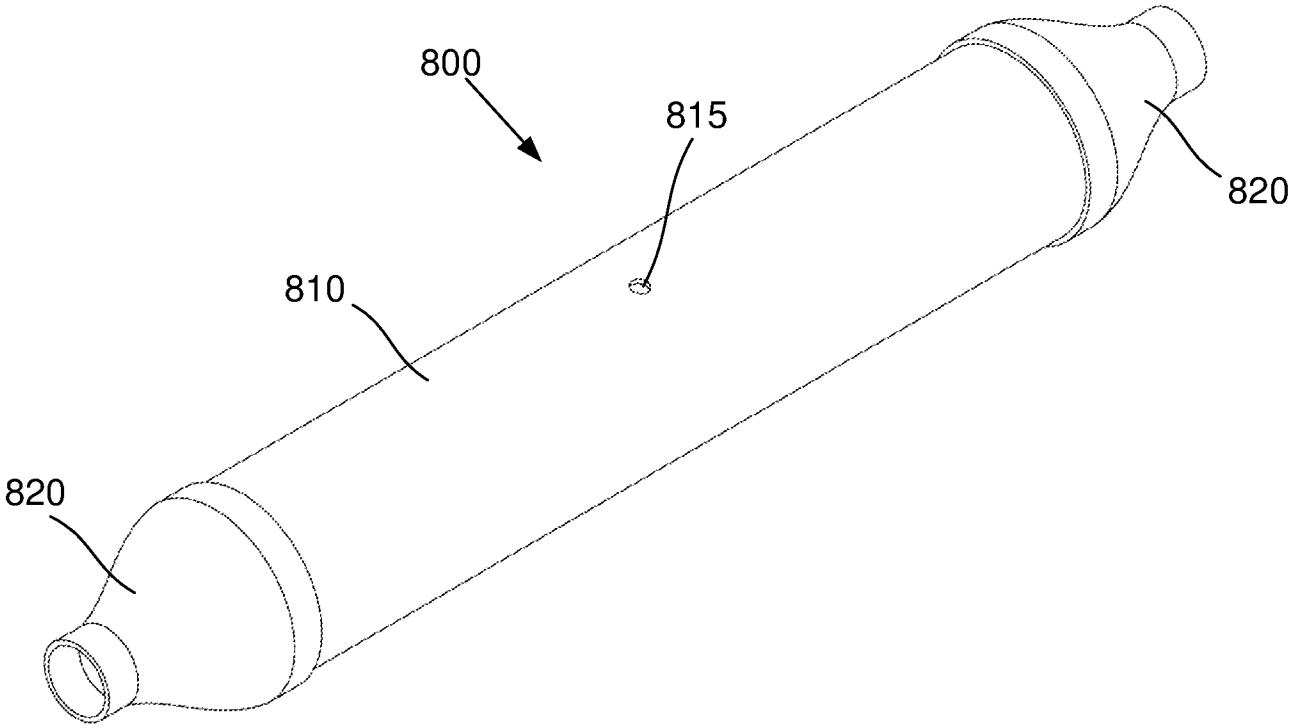
FIG. 5A is a perspective view of a fourth example of an apparatus for generating nanobubbles of a gas in a liquid.
Figure 5B:
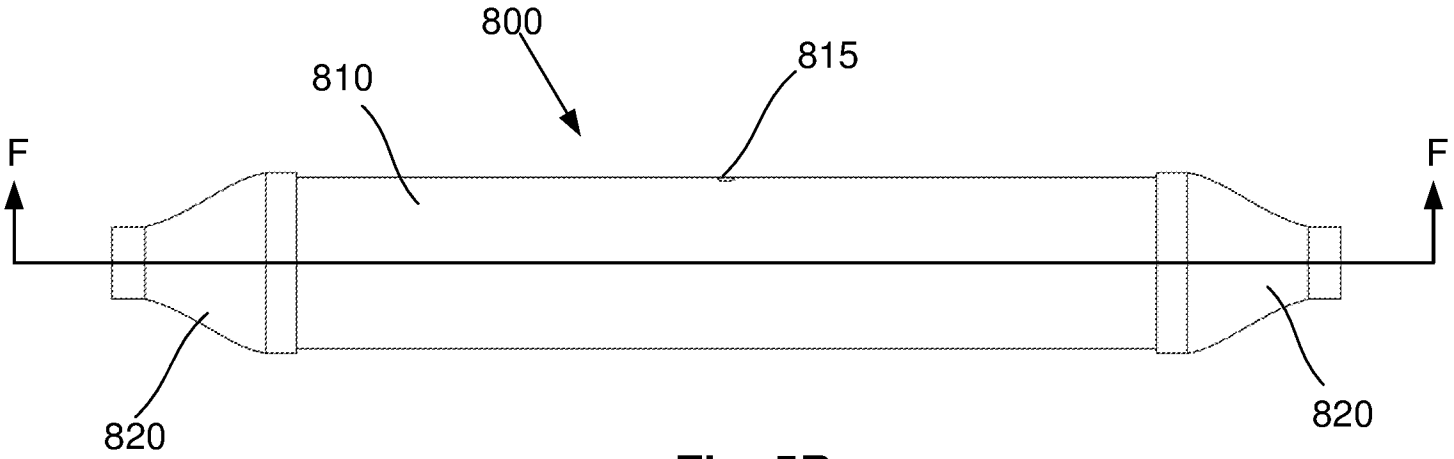
FIG. 5B is a side view of the apparatus of FIG. 5A.
Figure 5C:
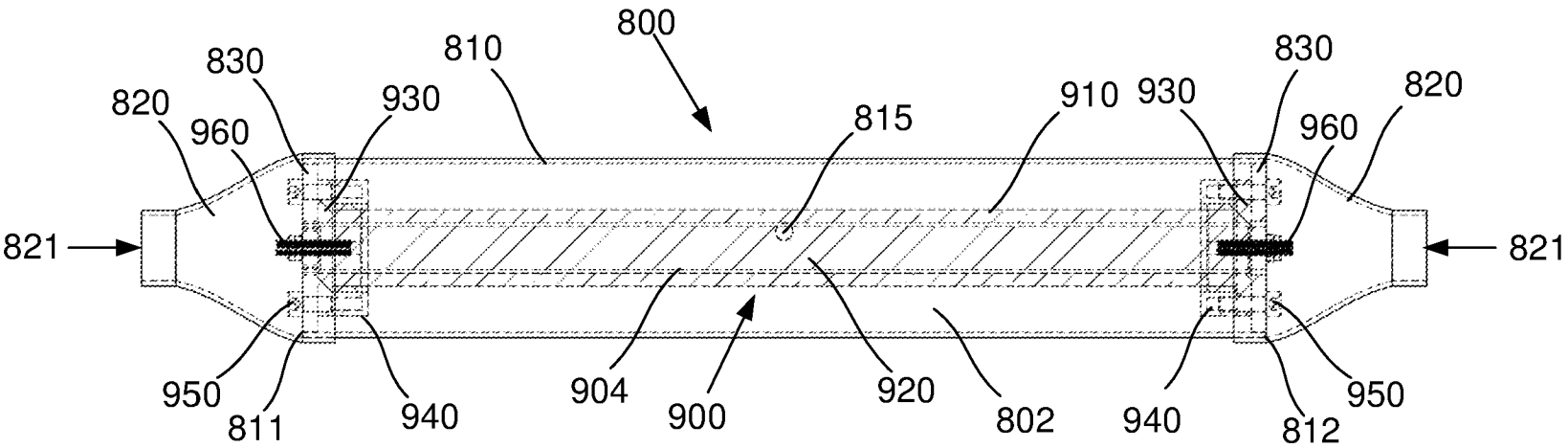
FIG. 5C is a sectional view of the apparatus taken through section F-F of FIG. 5B.
Figure 5D:
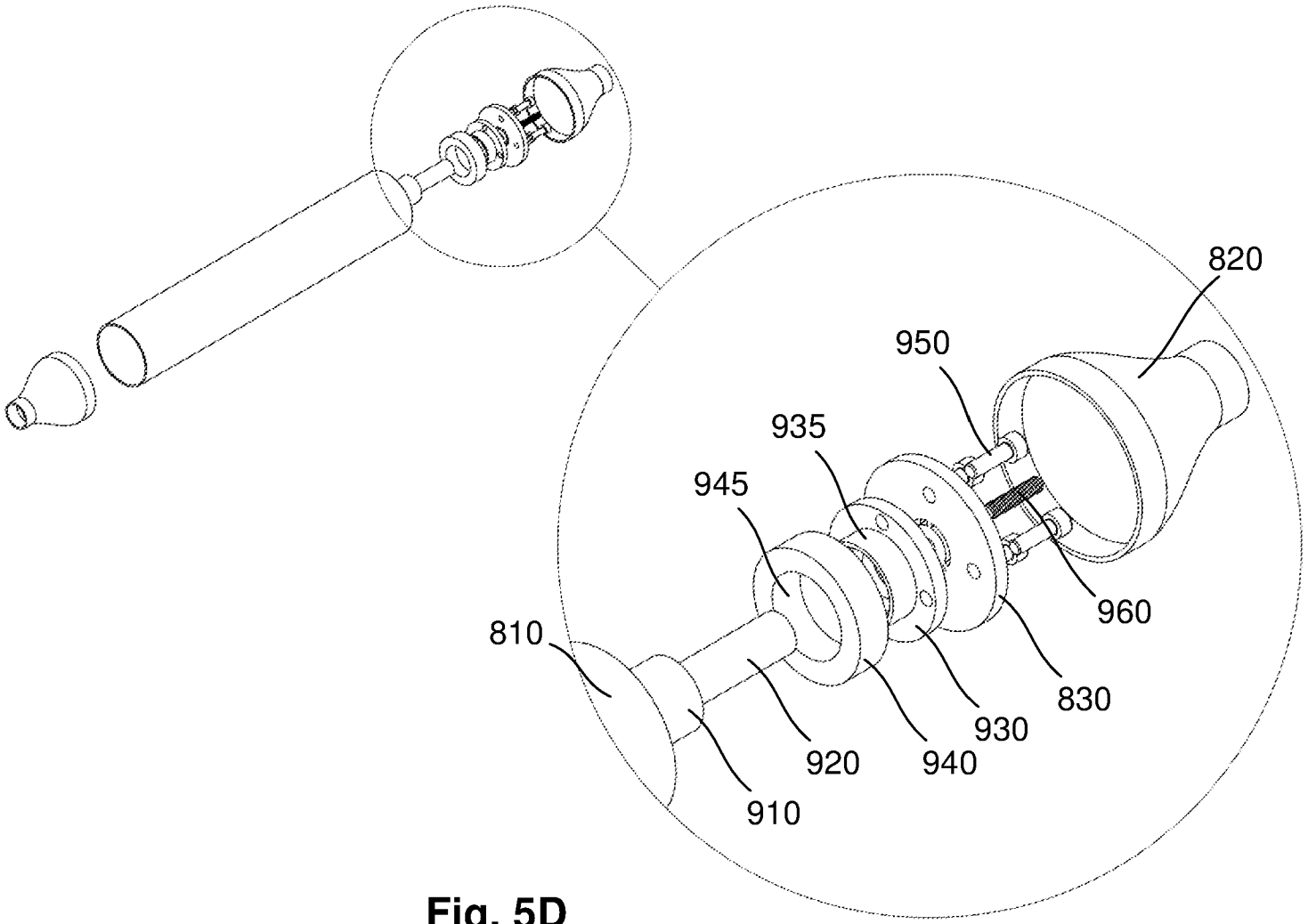
FIG. 5D is a detailed partial exploded view of the apparatus of FIG. 5A.
Figure 5E:
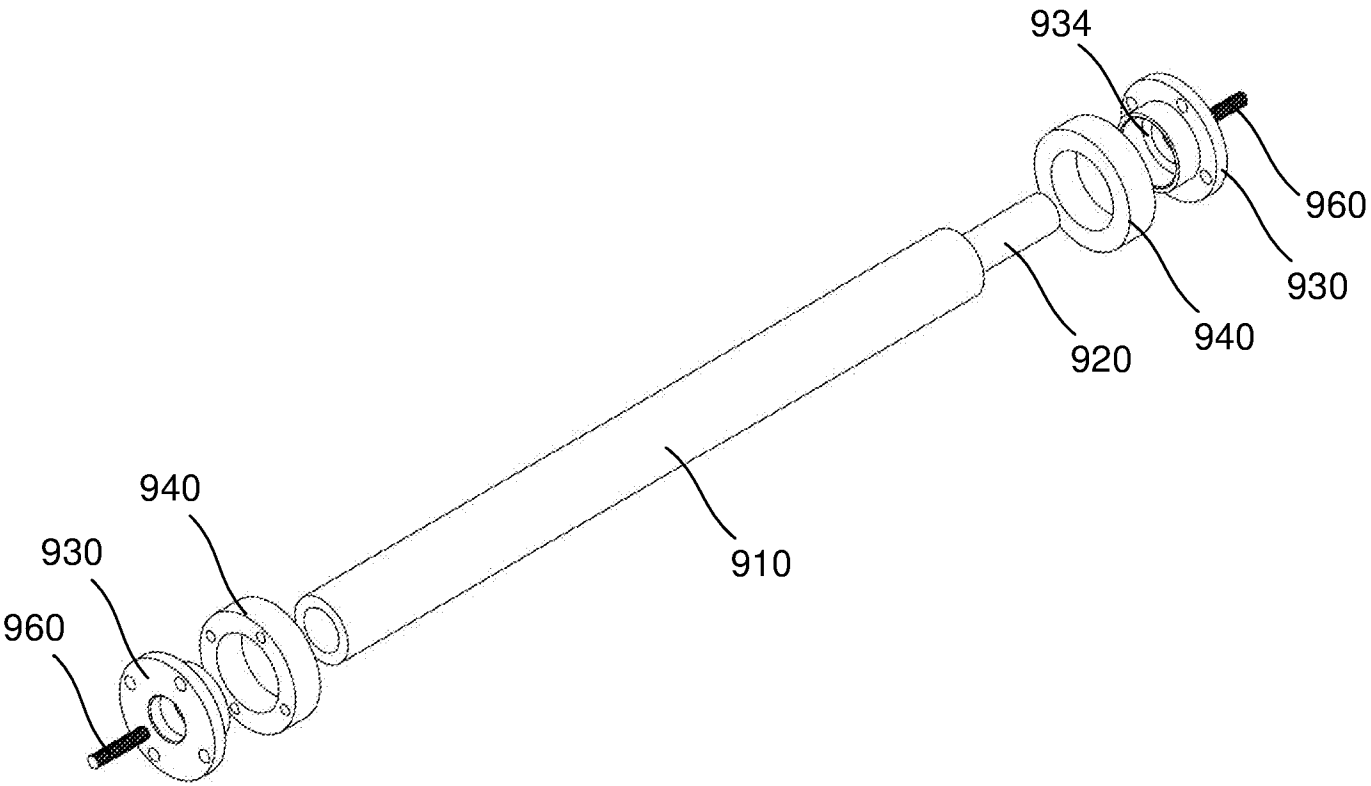
FIG. 5E is an exploded view of an internal sub-assembly of the apparatus of FIG. 5A.
Figure 5F:
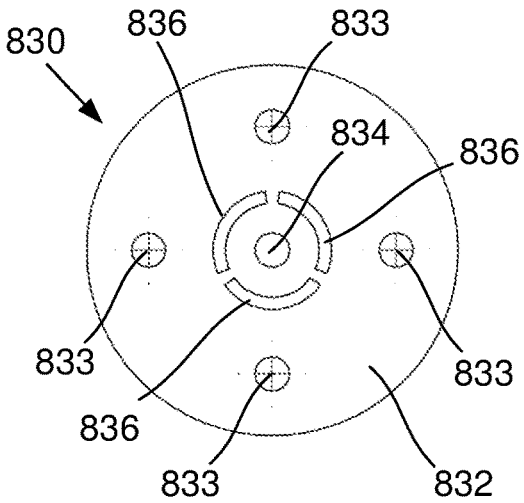
FIG. 5F is a plan view of an end plate from the apparatus of FIG. 5A.
Figure 5G:
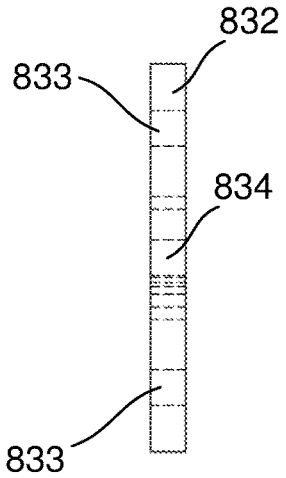
FIG. 5G is a side view of the end plate of FIG. 5F.
Figure 5H:
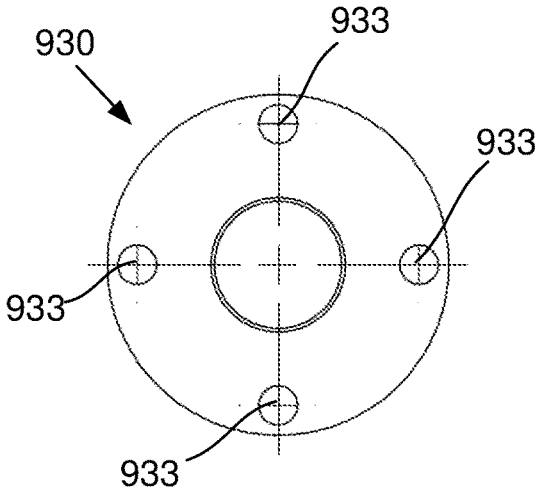
FIG. 5H is a plan view of a gas seal washer from the apparatus of FIG. 5A.
Figure 5I:
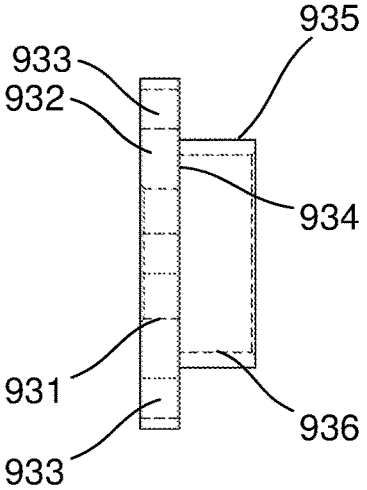
FIG. 5I is a side view of the gas seal washer of FIG. 5H.
Figure 5J:
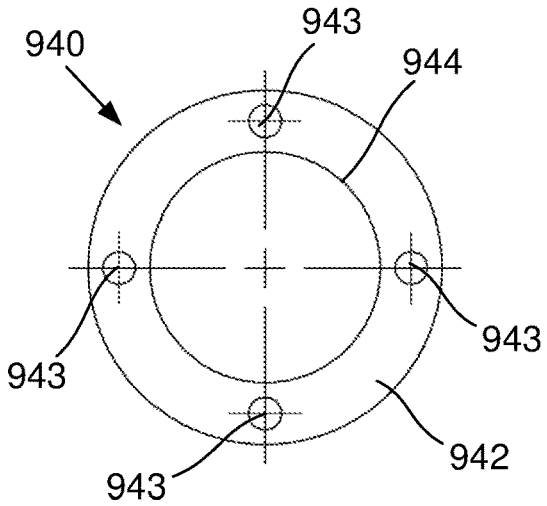
FIG. 5J is a plan view of a seal ring from the apparatus of FIG. 5A.
Figure 5K:
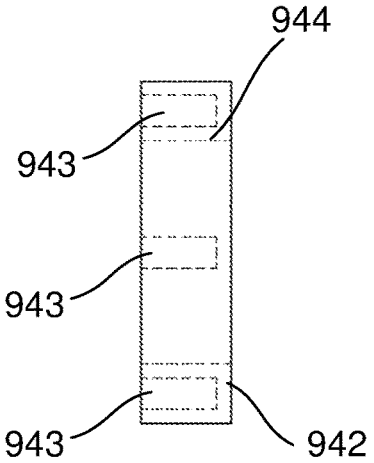
FIG. 5K is a side view of the seal ring of FIG. 5J.

Referring now to FIG. 4, a schematic block diagram of a system for generating nanobubbles of a gas in a liquid is illustrated. The system includes a gas generator 702 for producing purified gas such as ozone or oxygen, an apparatus 700 for generating nanobubbles of the gas in a liquid in accordance with any of the previously described examples, and a liquid reservoir 704. The liquid reservoir 704 may be filled with a quantity of the liquid which typically will be untreated water. Gas flow 705 from the gas generator 702 enters the apparatus 700 through a gas inlet as previously described. A liquid flow 706 from the reservoir enters the apparatus 700 through an inlet in an end cap assembly thereof. The gas flow permeates through a porous inner tube in the apparatus and enters into the flow of liquid passing through the apparatus. Nanobubbles are formed in the apparatus 700 which become entrained in the liquid flow such that a gas-liquid solution 707 exits the apparatus and typically will flow back into the reservoir (although the treated outflow could be discharged into a separate fluid reservoir if required). If the desired level of gas dissolution in the liquid can be achieved in one pass then the apparatus can be switched off otherwise, the process repeats until the desired gas concentration is attained.

A further example of an apparatus 800 for generating nanobubbles of a gas in a liquid shall now be described with reference to FIGS. 5A to 5K.

In this example, the apparatus 800 includes an outer tube or housing 810 having a gas inlet 815 disposed in a wall thereof to which a gas source is connected. A pair of end fittings 820 are attached to opposing ends 811, 812 of the outer tube 810 in any suitable manner. In one example the end fittings are conical reducers having openings 821 to permit a flow of liquid into and out of the apparatus 800. Liquid is able to flow in either direction through the apparatus 800 making it bi-directional. Various external fittings are able to be connected to the inlet/outlet of the end fittings 820 such as threaded, tri-clover and quick connect systems.

The apparatus 800 further includes an internal sub-assembly 900 housed within the outer tube 810 and arranged to extend axially therein. The sub-assembly 900 includes a porous tube 910, a centre rod 920 coaxially located within the porous tube 910 so as to define an annular liquid flow path 904 through the porous tube 910, and a supporting element 930 at each end of the porous tube 910. Each supporting element 930 is configured to receive an end of the porous tube 910 and is configured for mounting to an end plate 830 as shall be described in more detail below. The configuration of the porous tube 910 and solid centre rod 920 is similar to the arrangement described in respect of apparatus 100 in that the diameter of the centre rod is less than an internal diameter of the porous tube to thereby form an annular channel or liquid flow path when the rod and porous tube are coaxially aligned.

A pair of end plates 830 are disposed proximate opposing ends 811, 812 of the outer tube 810, the end plates 830 mounted to the supporting elements 930 of the sub-assembly 900 via fasteners 950 such as screws or bolts. Each end plate 830 has one or more openings 836 aligned with the liquid flow path 904 through the porous tube 910 to thereby permit flow of liquid between the porous tube 910 and the end fittings 820.

In this regard, it is to be appreciated that the openings 821 of the end fittings 820 are in fluid communication with the liquid flow path 904 through the porous tube 910 via the one or more openings 836 in a respective end plate 830 so as to allow a flow of liquid in an axial direction through the apparatus 800.

In operation, the gas inlet 815 allows a flow of gas (such as oxygen or ozone) into a chamber 802 formed between the outer tube 810 and the porous tube 910, the flow of gas permitted to permeate through a wall of the porous tube 910 into the liquid flow path 904, wherein, as the gas permeates through the wall of the porous tube 910, nanobubbles of gas are generated which become entrained in the liquid flow.

To assemble the apparatus 800, the centre rod 920 is located within the porous tube 910 and the ends of the porous tube 910 are brought into engagement with the supporting elements 930. The supporting elements 930 include a flange 932 and a cylindrical ring 935 projecting from the flange 932. The end portions of the porous tube 910 are received within the ring 935 so as to be located in abutment with an internal shoulder portion 934 of the flange 932. The flange 932 has a centre opening 921 to allow passage of liquid to and from the liquid flow path 904 of the porous tube 910 in use. In one example, the supporting element 930 is a Teflon machined gas seal washer. In the example illustrated, a stainless steel machined seal ring 940 is sleeved over the ring 935 of the supporting element 930 in abutment with the flange 932.

End plates 830 are then mounted to the flange 932 of the supporting element 930 via fasteners 950 (e.g. bolts) which are inserted through respective mounting holes 833 and 933. In the example shown, the fasteners 950 pass through holes 833, 933 and terminate in blind holes 943 of the seal ring 940. In this way, the end plate 830 is securely fastened to the supporting element 930 and seal ring 940. The end plates 830 are also coupled to the centre rod 920 by mechanical fasteners which act to support the centre rod 920 coaxially within the porous tube 910. In the example shown, all thread fasteners are screwed through threaded aperture 834 in an end plate 830 into a blind threaded aperture in the end of the centre rod 920. Each end plate 830 further includes annular openings 836 that may be discontinuous as shown which are aligned with the liquid flow path 904 through the porous tube 910 when assembled. Liquid is therefore able to flow along the liquid flow path in the porous tube 910, out through the openings 836 of the end plate 830 and into the conical reducer end fitting 820 whereby it exits the apparatus through outlet 821.

In this way, the internal sub-assembly 900 is constructed and mounted to the end plates 830. The outer tube 810 is then arranged over the sub-assembly and end plates 830 and the end fittings 820 are attached to the ends 811, 812 of the outer tube 810. The end fittings 820 may be welded to the outer tube 810 and likewise the end plates 830 may also be welded to the outer tube 810 in order to ensure the unit does not leak gas.

Figure 6A:
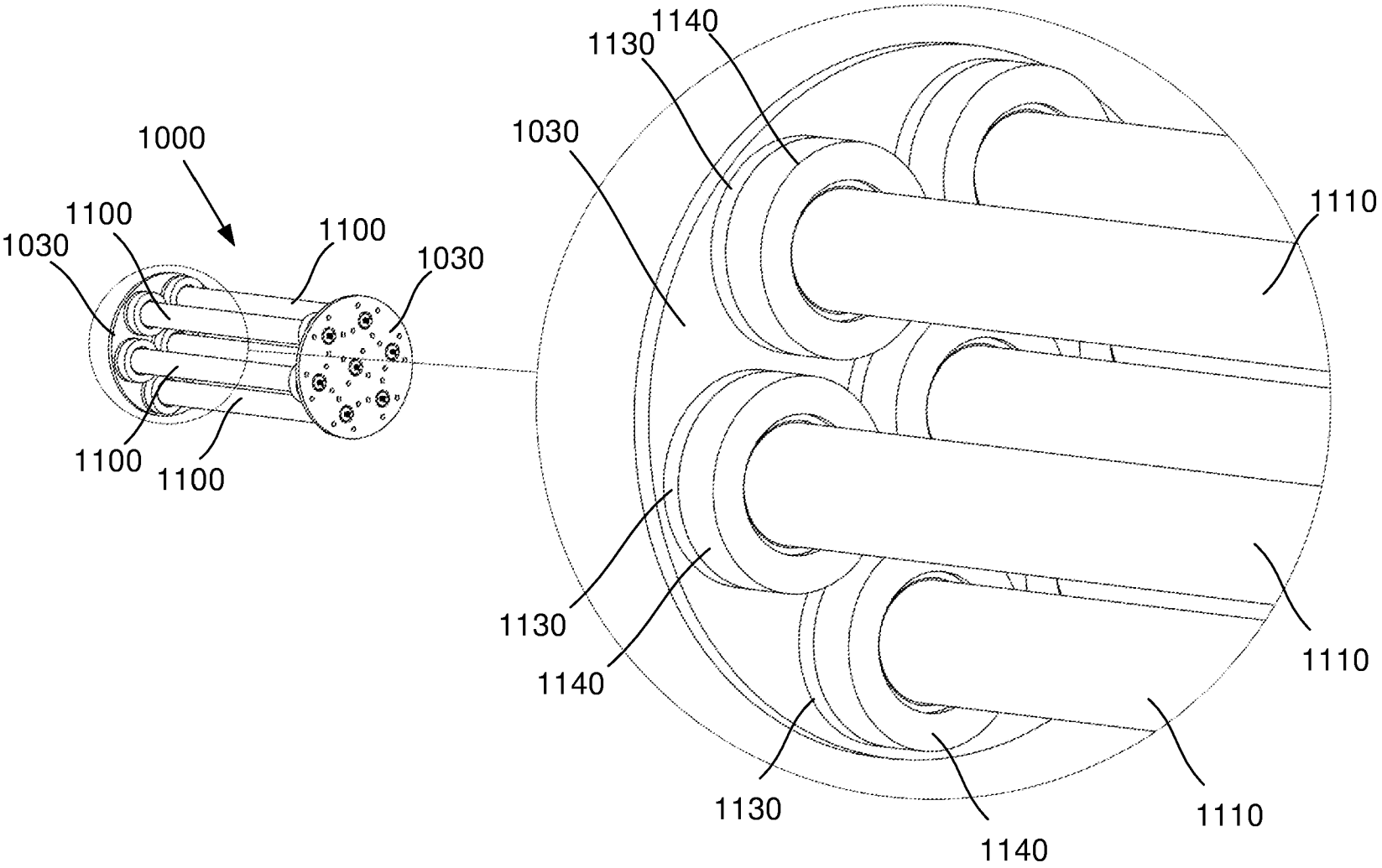
FIG. 6A is a detailed perspective view of an example of part of an apparatus for generating nanobubbles of a gas in a liquid showing multiple internal sub-assemblies of FIG. 5A mounted to end plates; and, FIG. 6B is a plan view of an end plate of the apparatus of FIG. 6A.
Figure 6B:
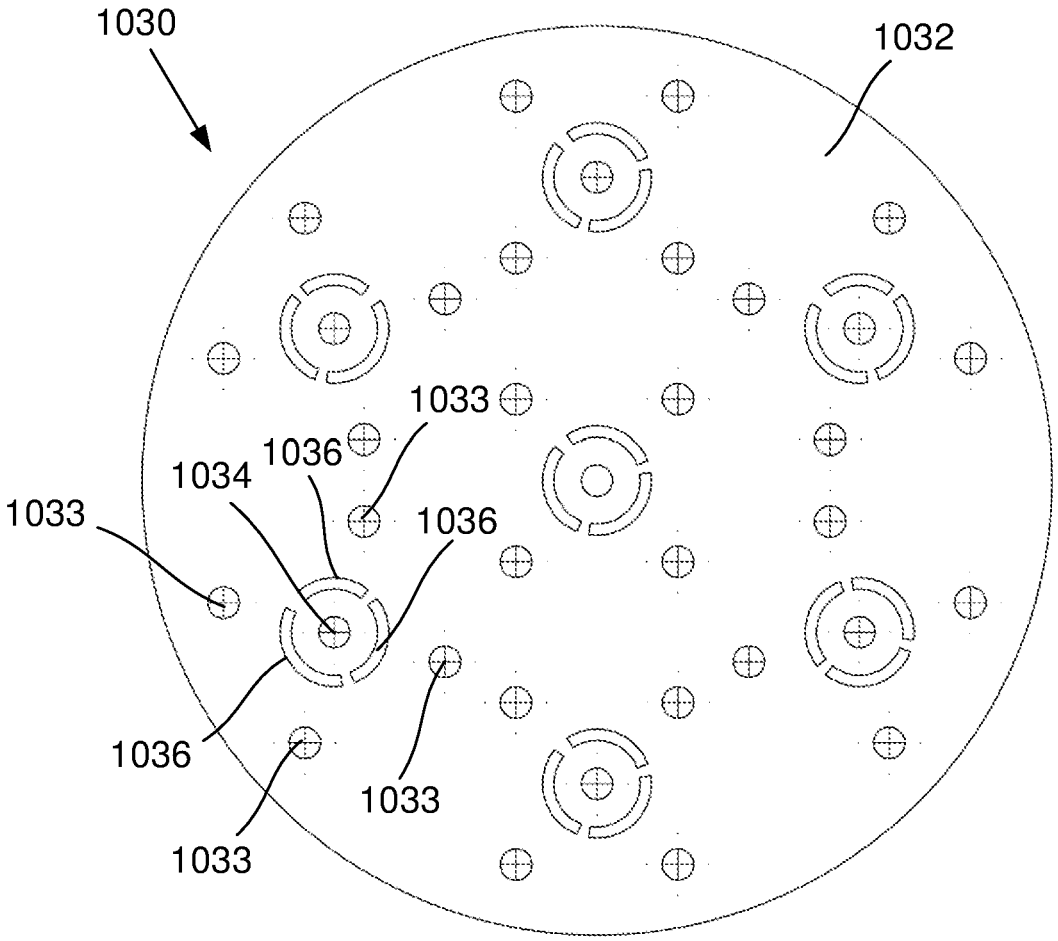

It is to be appreciated that the above described example readily permits the construction of a modular unit enabling a scalable version of the nanobubble generator to be manufactured for higher capacity flow rates. In order to build a larger unit with higher flow rate, several of the internal sub-assemblies as described above can be used in conjunction with each other. An example of this modular design capability is shown in FIGS. 6A and 6B. In this example, a nanobubble generator 1000 is shown (outer tube and end fittings not shown for clarity) comprising a plurality of internal sub-assemblies 1100 mounted to custom end plates 1030. The internal sub-assemblies 1100 are as previously described having a porous tube 1110, centre rod (not shown) and supporting elements 1130 as well as seal rings 1140.

The custom end plate 1030 for this generator is shown in FIG. 6B. As shown, mounting provisions are made in the plate 1030 for each sub-assembly 1100. In this regard, each mounting provision includes mounting holes 1033 for fasteners that attach to the supporting elements 1130. Annular openings 1036 are provided for each sub-assembly 1100 to allow passage of liquid into and out of the liquid flow path of the porous tube of each sub-assembly. Threaded apertures 1034 are also provided to allow the centre rod of each sub-assembly to be coupled to the end plate 1030 in order to coaxially align each centre rod with its respective porous tube. It will be appreciated that the end plate may be designed in any suitable manner to permit mounting of multiple sub-assemblies thereto and accordingly the flow rate through the apparatus can be significantly increased compared to previous examples described. The internal sub-assembly therefore permits modular design as any number of sub-assemblies may be incorporated into the generator.

Accordingly, in at least one example, the apparatus described herein enables the controlled formation of nanobubbles and associated gas dissolution into liquid solution. The concentration of gaseous nanobubbles in solution can be optimised for a given liquid flow rate through the apparatus. In particular, this enables effective levels of gas dissolution to be achieved with minimal passes of liquid through the apparatus which saves time and electrical cost in generating the purified gas. A highly efficient system for generating stable nanobubbles is therefore achieved. Early trials of the apparatus have indicated that concentrations of up to 30 parts per million (ppm) of ozone and 50 ppm of oxygen in aqueous solution are able to be achieved in a single pass. In the case of oxygen, early trials further indicate that elevated levels of dissolved oxygen (greater than 40 ppm) injected using the nanobubble generating apparatus can be stably held in solution for a long period of time (at least greater than two weeks).

Compared to traditional machines that inject micro or larger bubbles of ozone into water, higher levels of ozone in solution can be achieved with less off-gas ozone. As an example, when using the nanobubble generator in an enclosed small pork boning room, at 5 ppm of ozone in solution, measured gaseous ozone in the room was found to be less than 0.03 ppm. For traditional machines, such as venture style injectors, at ozone concentrations of greater than 2 ppm, off-gas levels would be greater than 0.1 ppm which presents a safety risk to operators and would likely require the machine to be shutdown.

The examples described are simple arrangements with no moving parts and when fully assembled become completely sealed, non-serviceable units that require no maintenance for their life. Gas is able to be held in the apparatus under pressure with no leakage which further assists in optimising gas dissolution in to the liquid by enabling the gas flow rate and pressure to be adjusted in accordance with the liquid flow rate and pressure.

The in-line and compact nature of the apparatus enables it to be easily installed, for example in existing factory piping systems, in environments where space is limited or at a point of use (where it may be deployed in a mobile unit). At least some examples further enable a modular design construction which can achieve significantly higher flow rates through the apparatus.

As previously mentioned, this technology has wide reaching applications including the use of ozone in sanitisation of food processing facilities, medical facilities and equipment, water treatment, food preservation, and in any industrial, retail or commercial application where bacteria may be present and harmful to the product or environment. The use of oxygenated water can be used in medicine, agriculture, mining, petrochemicals, waste management and water treatment.

Accordingly, it will be appreciated that the above described Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

Persons skilled in the art will appreciate that numerous variations and modifications will become apparent. All such variations and modifications which become apparent to persons skilled in the art, should be considered to fall within the spirit and scope that the invention broadly appearing before described.

The invention claimed is:

1. Apparatus for generating nanobubbles of a gas in a liquid, the apparatus including:

a) an outer tube;

b) a plurality of internal sub-assemblies housed within the outer tube and arranged to extend axially therein, each sub-assembly including:

i) a porous tube;

ii) a centre rod coaxially located within the porous tube so as to define an annular liquid flow path through the porous tube;

iii) a supporting element at each end of the porous tube, each supporting element configured to receive an end of the porous tube;

c) a pair of end plates disposed proximate opposing ends of the outer tube, the end plates mounted to the respective supporting elements of each sub-assembly and each end plate having openings that in use allow passage of liquid to and from the respective liquid flow paths of the porous tubes of each sub-assembly;

d) a pair of end fittings attached to the respective ends of the outer tube so as to cover the end plates and sub-assemblies, each end fitting having an opening in fluid communication with the liquid flow path of each sub-assembly via the openings in a respective end plate so as to allow a flow of liquid in an axial direction through the apparatus; and, e) a gas inlet for allowing a flow of gas into a chamber formed between the outer tube and plurality of sub-assemblies, the flow of gas permitted to permeate through walls of the porous tube of each sub-assembly into the liquid flow paths, wherein, as the flow of gas permeates through the walls of each porous tube, nanobubbles of gas are generated which become entrained in the flow of liquid.

2. The apparatus according to claim 1, wherein the end plates are coupled to the centre rods of each sub-assembly by mechanical fasteners which act to support the centre rods co-axially within the porous tubes.

3. The apparatus according to claim 2, wherein the supporting elements include a flange and a ring projecting from the flange in which the end of the porous tube is located in abutment with an internal shoulder portion of the flange, the flange having a centre opening to allow passage of liquid from the liquid flow path of the porous tube.

4. The apparatus according to claim 3, wherein the supporting element is a gas seal washer.

5. The apparatus according to claim 2, wherein a seal ring is sleeved over the ring of the supporting element in abutment with the flange of the supporting element.

6. The apparatus according to claim 1, wherein the openings in the end plates are annular.

7. The apparatus according to claim 6, wherein the openings in the end plates associated with each porous tube are discontinuous.

8. The apparatus according to claim 1, wherein the end fittings are conical reducers.

9. Apparatus according to claim 1, wherein at least a portion of the nanobubbles of gas are generated at a gas-liquid interface proximate an inner surface of each porous tube.

10. Apparatus according to claim 1, wherein the gas inlet is provided in a wall of the outer tube.

11. Apparatus according to claim 1, wherein each porous tube has an average pore size of between about 40 to 200 nm.

12. Apparatus according to claim 1, wherein each porous tube is one of:

a) a sintered metallic tube;

b) a porous ceramic tube; and, c) a porous plastic tube.

13. Apparatus according to claim 12, wherein each porous tube is the sintered metallic tube, the sintered metallic tube being formed from a metal, the metal being one of:

a) stainless steel;

b) brass;

c) bronze;

d) aluminium; and, e) titanium.

14. Apparatus according to claim 12, wherein each porous tube is the porous ceramic tube, the porous ceramic tube being formed from a ceramic material, the ceramic material being one of:

a) silicon carbide;

b) alumina; and, c) titania.

15. Apparatus according to claim 1, wherein the outer tube is stainless steel.

16. Apparatus according to claim 1, wherein each centre rod is stainless steel.

17. Apparatus according to claim 1, wherein liquid flow through the apparatus is bi-directional.

18. Apparatus according to claim 1, wherein liquid flows through the apparatus without a substantial change in direction.

19. Apparatus according to claim 1, wherein the flow of liquid is a flow of water.

20. Apparatus according to claim 1, wherein the flow of gas is a flow of at least one of:

a) ozone;

b) oxygen;

c) nitrogen;

d) hydrogen; and, e) carbon dioxide.

* * * * *